US012644656B2

(12) United States Patent
Kawata et al.

(10) Patent No.: US 12,644,656 B2
(45) Date of Patent: Jun. 2, 2026

(54) CONTAINER, COLD PLATE, AND LIQUID FEEDER

(71) Applicant: Nidec Corporation, Kyoto (JP)

(72) Inventors: Keisuke Kawata, Kyoto (JP); Takehito Tamaoka, Kyoto (JP); Toshihiko Tokeshi, Kyoto (JP); Tomoyuki Honda, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 118 days.

(21) Appl. No.: 18/585,347

(22) Filed: Feb. 23, 2024

(65) Prior Publication Data

US 2024/0288228 A1 Aug. 29, 2024

(30) Foreign Application Priority Data

Feb. 27, 2023 (JP) ..... 2023-028970

(51) Int. Cl.
*F28F 3/12* (2006.01)

(52) U.S. Cl.
CPC ..... *F28F 3/12* (2013.01)

(58) Field of Classification Search
CPC ..... H05K 7/20272; H05K 7/20281; H05K 7/20218; F04B 11/0033; B67D 7/36; F28F 3/12
See application file for complete search history.

(56) References Cited

U.S. PATENT DOCUMENTS 3,559,727 A * 2/1971 Hill ..... H05K 7/20272 237/66
5,137,079 A * 8/1992 Anderson ..... G05D 23/022 165/104.33
6,871,670 B2 * 3/2005 Suzuki ..... F15B 1/103 220/721
6,948,556 B1 * 9/2005 Anderson ..... F28D 15/043 165/80.4
7,870,893 B2 * 1/2011 Ouyang ..... G05D 23/20 165/104.31
9,992,910 B2 * 6/2018 Liao ..... B67D 7/36
2005/0173097 A1 * 8/2005 Kitajima ..... F28D 15/00 62/118
2010/0079952 A1 * 4/2010 Liang ..... H01L 23/427 62/3.2
2013/0139903 A1 * 6/2013 Haas ..... F01P 11/029 137/197

* cited by examiner

*Primary Examiner* — Tho V Duong
(74) *Attorney, Agent, or Firm* — Keating & Bennett, LLP

(57) ABSTRACT

A container includes a first container portion and a second container portion. The first container portion includes a flow path therein through which liquid passes. The second container portion is connected to the flow path and is capable of containing the liquid. The second container portion includes a reservoir and a changing assembly. The reservoir can store the liquid in at least a portion thereof. The changing assembly changes the volume of the reservoir according to a change in the liquid.

16 Claims, 14 Drawing Sheets

CONTAINER, COLD PLATE, AND LIQUID FEEDER

CROSS-REFERENCE TO RELATED APPLICATIONS

The present application claims priority under 35 U.S.C. § 119 to Japanese Patent Application No. 2023-028970, filed on Feb. 27, 2023, the entire contents of which are hereby incorporated herein by reference.

1. FIELD OF THE INVENTION

The present disclosure relates to containers, cold plates, and liquid feeders.

2. BACKGROUND

A conventional heat exchanger assembly includes a heat exchanger that exchanges heat between a first exchange fluid and a second exchange fluid, a pressure pulse buffer device, and piping. The piping connects the heat exchanger and the pressure pulse buffer device. The pressure pulse buffer device reduces pressure pulses in the heat exchanger.

However, in the above-described conventional heat exchanger assembly, since the heat exchanger and the pressure pulse buffer device are connected and separated by the piping, it is difficult for the pressure pulse buffer device to cope with a change occurring in the liquid.

SUMMARY

According to an example embodiment of a container of the present disclosure, the container includes a first container portion and a second container portion. The first container portion includes a flow path therein through which liquid passes. The second container portion is connected to the flow path and is capable of containing the liquid. The second container portion includes a reservoir and a changing assembly. The reservoir can store the liquid in at least a portion thereof. The changing assembly changes the volume of the reservoir according to a change in the liquid.

According to an example embodiment of a cold plate of the present disclosure, the cold plate includes the container.

According to an example embodiment of a liquid feeder of the present disclosure, the liquid feeder includes the container, a first pump, and a second pump. The first pump delivers the liquid to an outflow portion. The second pump delivers the liquid flowing in from an inflow portion to the first pump. The first container portion includes a first surface on which the inflow portion and the outflow portion are located. The first pump and the second pump are located between the first surface and the second container portion, and are adjacent to each other in the longitudinal direction of the first surface.

The above and other elements, features, steps, characteristics and advantages of the present disclosure will become more apparent from the following detailed description of the example embodiments with reference to the attached drawings.

DETAILED DESCRIPTION

Figure 1:
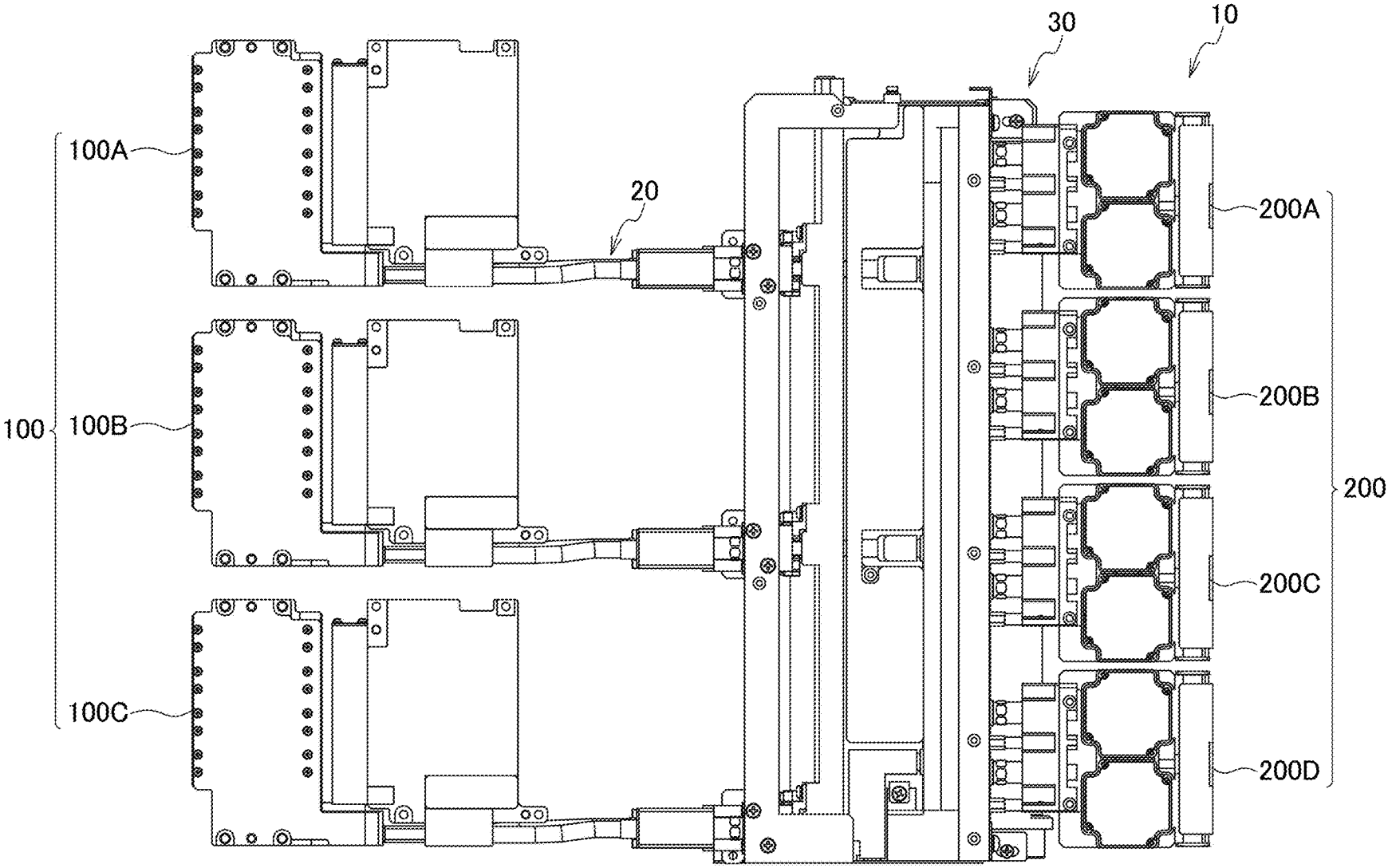
FIG. 1 is a schematic diagram of a cooling mechanism according to an example embodiment of the present disclosure.

Hereinafter, example embodiments of the present disclosure will be described with reference to the drawings. Note that in the drawings, the same or corresponding parts will be denoted by the same reference signs and description of such parts will not be repeated. In the specification of the present application, an X-axis, a Y-axis, and a Z-axis that are orthogonal to each other may be described in order to facilitate the understanding of the disclosure. Although typically, the Z-axis is parallel to a vertical direction, and the X-axis and the Y-axis are parallel to a horizontal direction, orientations of the X-axis, the Y-axis, and the Z-axis are not limited thereto.

First, a cooling mechanism 10 of a first example embodiment will be described with reference to FIGS. 1 and 2. FIG. 1 is a schematic diagram of the cooling mechanism 10. The cooling mechanism 10 is used for cooling heat generating components. For example, the cooling mechanism 10 may cool heat generating components of an electronic device. A heat generating component is, for example, a circuit of an electronic device. Further, a heat generating component is, for example, a light source of an electronic device. Note that an electronic device may be any of a server, a projector, a notebook personal computer, and a two-dimensional display device.

The cooling mechanism 10 includes a pipe 20, a connector 21, a radiator 30, a cold plate 100, and a liquid feeder 200. The cooling mechanism 10 circulates liquid as refrigerant. The liquid feeder 200 sequentially feeds the liquid, so that the liquid circulates in the cooling mechanism 10.

The liquid circulating in the cooling mechanism 10 may be water. Alternatively, the circulating liquid may be a mixed liquid. For example, the mixed liquid may contain water and propylene glycol.

The cold plate 100 absorbs heat of a heat source of a target device. The cold plate 100 contains liquid therein. The cold plate 100 corresponds to an example of a "container". The cold plate 100 is made of a metal having high thermal conductivity such as copper or aluminum. The cold plate 100 is a rectangular plate component extending in the X-axis direction and the Y-axis direction. The shape of the cold plate 100 may be other than a rectangular shape.

Specifically, the cold plate 100 conducts heat of the heat source to the liquid. Accordingly, the cold plate 100 is disposed near the heat source of the target device. For example, the cold plate 100 is disposed opposite to the heat source. Alternatively, the cold plate 100 may be disposed in contact with the heat source. When the cold plate 100 is disposed opposite to the heat source, the cold plate 100 faces the heat source via a transmission member. The transmission member is, for example, heat grease. The heat grease enters a minute gap between the cold plate 100 and the heat source. This reduces the gap between the cold plate 100 and the heat source. As a result, the heat conductivity from the heat source to the cold plate 100 is improved.

The cold plate 100 includes a plurality of cold plates. Specifically, the cold plate 100 includes a first cold plate 100A, a second cold plate 100B, and a third cold plate 100C.

The radiator 30 releases the heat of the liquid flowing through the pipe 20 to the outside. The radiator 30 is connected to the cold plate 100 via the pipe 20. The heat of the heat source is transferred through the cold plate 100 and absorbed by the liquid inside. Thereafter, the liquid having passed through the cold plate 100 returns to the radiator 30, and the radiator 30 releases the heat to the outside, whereby the liquid in the pipe 20 is cooled. Then, the cooled liquid is fed again to the pipe 20 by the liquid feeder 200.

The liquid feeder 200 feeds the liquid toward the radiator 30 and the cold plate 100. The liquid feeder 200 is connected to the radiator 30. The liquid fed from the liquid feeder 200 flows toward the radiator 30. Then, the liquid flows from the radiator 30 toward the cold plate 100.

The liquid feeder 200 includes a plurality of liquid feeders. Specifically, the liquid feeder 200 includes a first liquid feeder 200A, a second liquid feeder 200B, a third liquid feeder 200C, and a fourth liquid feeder 200D. Each of the first liquid feeder 200A to the fourth liquid feeder 200D is connected to the radiator 30. Each of the first liquid feeder 200A to the fourth liquid feeder 200D is connected to the cold plate 100 via the radiator 30.

Figure 2:
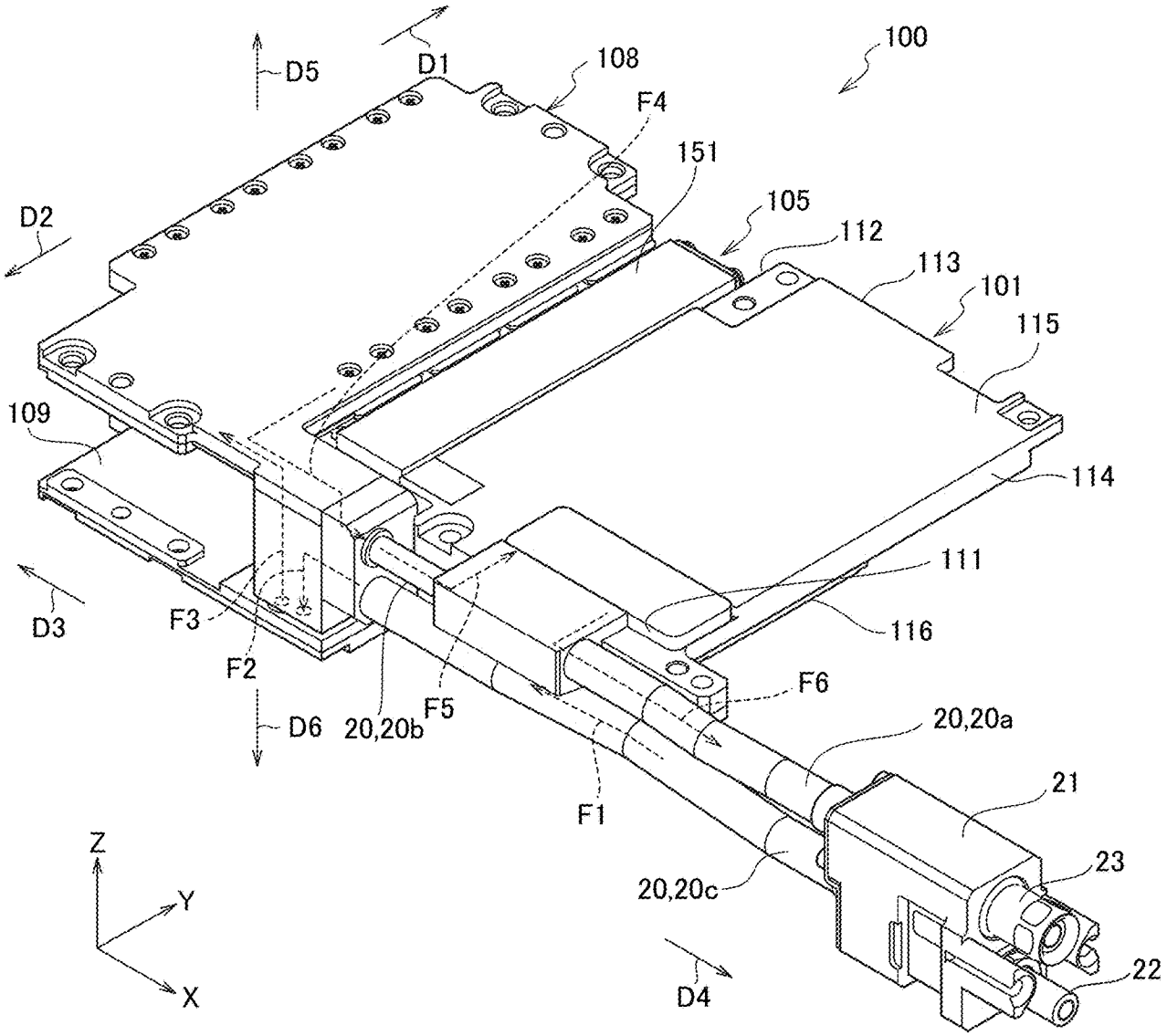
FIG. 2 illustrates piping of the cooling mechanism according to the present example embodiment.

As illustrated in FIG. 2, the connector 21 connects the pipe 20 to the radiator 30. The connector 21 includes a first connecting portion 22 and a second connecting portion 23. The first connecting portion 22 connects the radiator 30 and the pipe 20. Liquid flows into the pipe 20 from the radiator 30 by the first connecting portion 22. The second connecting portion 23 connects the pipe 20 and the radiator 30. Liquid flows into the pipe 20 from the radiator 30 by the second connecting portion 23.

The pipe 20 has a tubular shape. For example, the pipe 20 is made of resin. In one example, the pipe 20 is a rubber tube. The pipe 20 connects the radiator 30 and the cold plate 100. Therefore, the liquid circulates through the liquid feeder 200, the radiator 30, and the cold plate 100 via the pipe 20. The pipe 20 may be a metal pipe. When the pipe is made of metal, evaporation of liquid can be suppressed as compared with a pipe made of resin.

FIG. 2 illustrates the pipe 20 of the cooling mechanism 10. As illustrated in FIG. 2, the pipe 20 includes a pipe 20*a*, a pipe 20*b*, and a pipe 20*c*.

The pipe 20*c* connects the radiator 30 and the cold plate 100. Specifically, the pipe 20*c* connects the first connecting portion 22 of the connector 21 and the cold plate 100. Therefore, the liquid cooled in the radiator 30 flows toward the cold plate 100 through the pipe 20*c*. The liquid absorbs the heat from the heat source in the cold plate 100. The liquid passes through the pipe 20*b*.

The pipe 20*a* connects the cold plate 100 and the radiator 30. Specifically, the pipe 20*a* connects the second connecting portion 23 of the connector 21 and the cold plate 100. The liquid having absorbed heat in the cold plate 100 flows toward the radiator 30 through the pipe 20*a*. In addition, the liquid is pushed out in the liquid feeder 200 and circulates again through the pipe 20*a*, the pipe 20*b*, and the pipe 20*c*.

Figure 3:
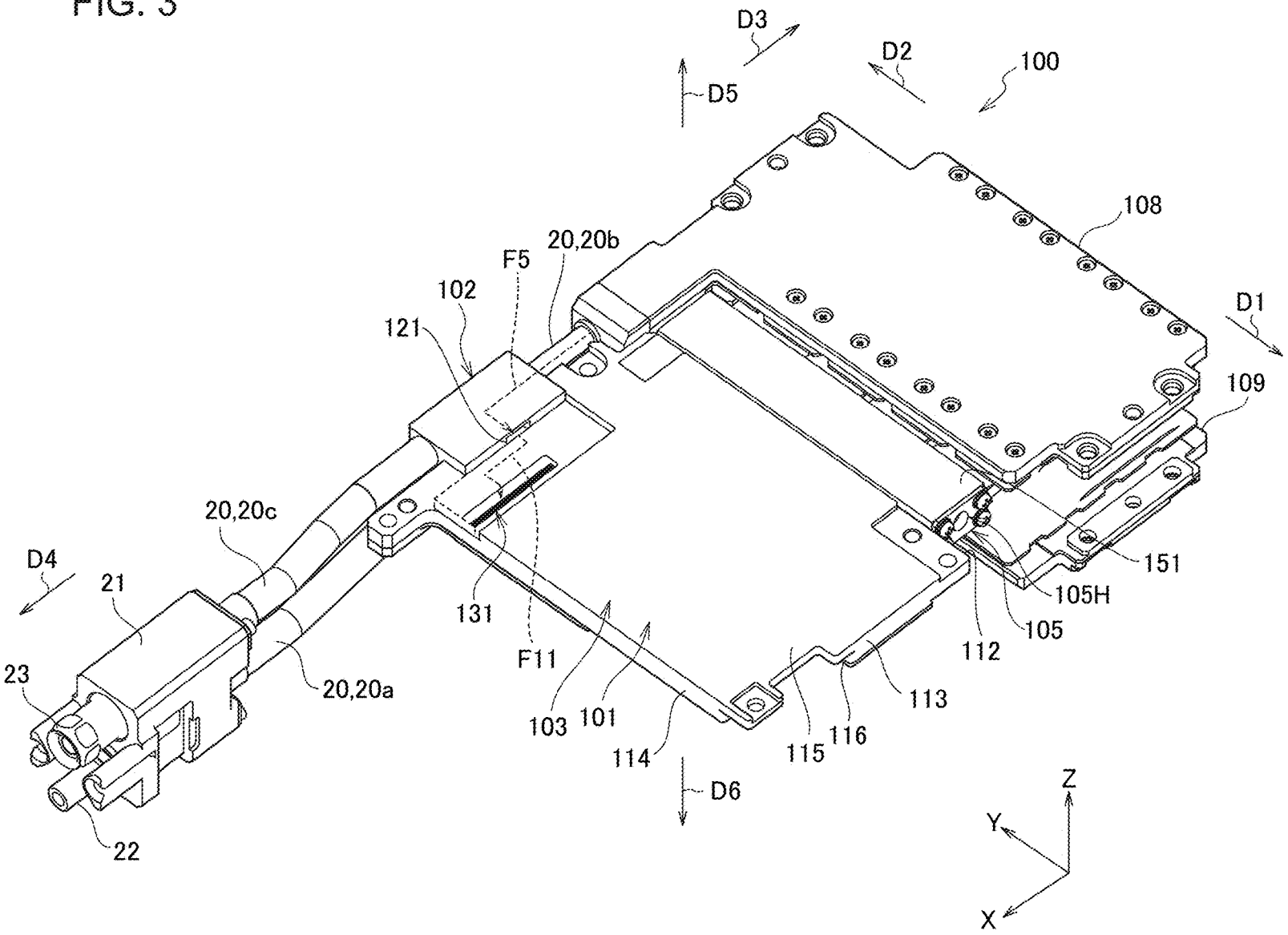
FIG. 3 illustrates the cold plate illustrated FIG. 2 as viewed from another angle.
Figure 4:
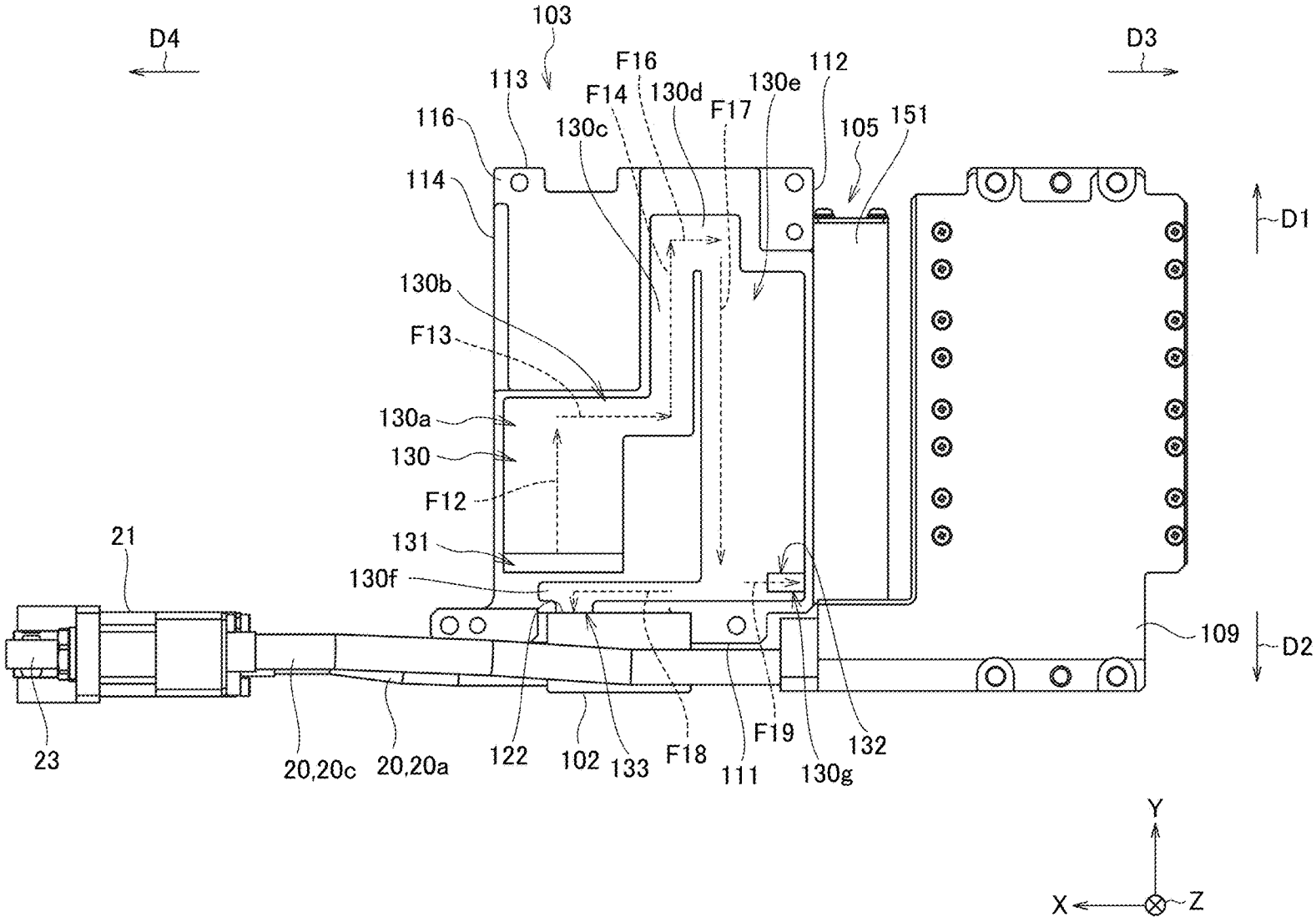
FIG. 4 illustrates the cold plate illustrated in FIG. 2 as viewed from still another angle.

Next, the cold plate 100 will be described in detail with reference to FIGS. 2 to 4. FIG. 3 illustrates the cold plate 100 illustrated FIG. 2 as viewed from another angle. FIG. 4 illustrates the cold plate 100 illustrated in FIG. 2 as viewed from still another angle.

The cold plate 100 includes a first liquid container portion 101, a second liquid container portion 105, a third liquid container portion 108, and a fourth liquid container portion 109. The liquid passes through each of the first liquid container portion 101, the second liquid container portion 105, the third liquid container portion 108, and the fourth liquid container portion 109. The first liquid container portion 101 corresponds to an example of a "first container portion". The second liquid container portion 105 corresponds to an example of a "second container portion".

For example, as illustrated in FIG. 2, the liquid moves from the first connecting portion 22 of the connector 21 to the second connecting portion 23 of the connector 21 via the fourth liquid container portion 109, the third liquid container portion 108, and the first liquid container portion 101. Specifically, the liquid passes through the pipe 20*c* from the first connecting portion 22 of the connector 21. The flow of the liquid passing through the pipe 20*c* is a flow F1.

Then, the liquid flows into the fourth liquid container portion 109. The flow of the liquid flowing into the fourth liquid container portion 109 and passing through the fourth liquid container portion 109 is a flow F2.

Further, the liquid flows into the third liquid container portion 108. The flow of the liquid flowing into the third liquid container portion 108 is a flow F3. Then, the flow of the liquid passing through the third liquid container portion 108 toward the pipe 20*b* is a flow F4.

Then, the flow of the liquid passing through the pipe 20*b* and flowing into the first liquid container portion 101 is a flow F5. Then, the flow of the liquid passing through the first liquid container portion 101 and flowing into the pipe 20*c* is a flow F6. Thereafter, the liquid moves to the radiator 30. As described above, the liquid having absorbed heat in the cold plate 100 flows toward the radiator 30 through the pipe 20*c*.

Each of the third liquid container portion 108 and the fourth liquid container portion 109 has an internal flow path (not illustrated) and a fin unit (not illustrated). The liquid passes through the internal flow path. The fin unit is disposed in the internal flow path. The fin unit may have a plurality of fins. Since the fin unit has a large contact area with the liquid, heat is efficiently transferred to the liquid.

In addition, the liquid flowing through the pipe 20*c* flows into the inside of the third liquid container portion 108 after flowing into the inside of the fourth liquid container portion 109, but the present disclosure is not limited thereto. For example, the liquid flowing through the pipe 20*c* may flow into the inside of the third liquid container portion 108 and the inside of the fourth liquid container portion 109. That is, the pipe 20*c* is connected to the third liquid container portion 108 and the fourth liquid container portion 109. For example, the pipe 20*c* may have a branch portion connected to the third liquid container portion 108 and the fourth liquid container portion 109. In this case, the pipe 20*b* is connected to the third liquid container portion 108 and the fourth liquid container portion 109. Therefore, the liquid flows into the pipe 20*b* from the third liquid container portion 108 and the fourth liquid container portion 109.

The first liquid container portion 101 contains liquid. The first liquid container portion 101 includes a linking part 102 and a main body 103.

The linking part 102 is connected to the pipe 20*b* and the pipe 20*c*. As illustrated in FIGS. 3 and 4, the linking part 102 includes an inflow portion 121 and an outflow portion 122.

The inflow portion 121 allows the liquid having passed through the pipe 20*b* to flow into the main body 103. The inflow portion 121 has a through hole penetrating from the connecting portion of the pipe 20*b* toward the inside of the main body 103. Therefore, as in the flow F5 illustrated in FIG. 3, the liquid moving in the pipe 20*b* flows into the internal flow path 130 of the main body 103 via the inflow portion 121.

The outflow portion 122 causes the liquid to flow out from the internal flow path 130 of the main body 103 to the pipe 20*c*. The outflow portion 122 has a through hole penetrating from the internal flow path 130 of the main body 103 toward the connecting portion of the pipe 20*c*. Therefore, as in the flow F6 illustrated in FIG. 2 from the outflow portion 122 illustrated in FIG. 4, the liquid flows out from the internal flow path 130 of the main body 103 to the pipe 20*c*.

As illustrated in FIG. 3, the main body 103 has a plurality of surfaces. The plurality of surfaces of the main body 103 include a first main surface 115, a second main surface 116, a first side surface 111, a second side surface 112, a third side surface 113, and a fourth side surface 114.

The first main surface 115 faces a heat generating component. For example, a heat generating component may be placed on the first main surface 115. The first main surface 115 corresponds to an example of an "opposing surface". The first main surface 115 is located on a first direction D1 side of the linking part 102. The first direction D1 indicates a direction from the linking part 102 toward the main body 103. The linking part 102 is located on a second direction D2 side of the first main surface 115. The second direction D2 indicates a direction opposite to the first direction D1. The first direction D1 and the second direction D2 are directions intersecting a direction in which the gravity acts. In FIG. 3, a part of the first main surface 115 is omitted.

The linking part 102 is fixed to the first side surface 111. That is, the inflow portion 121 and the outflow portion 122 are disposed on the first side surface 111. The first side surface 111 corresponds to an example of a "first surface". The first side surface 111 is located between the second side surface 112 and the fourth side surface 114. The first side surface 111 extends along a third direction D3 and a fourth direction D4. The third direction D3 indicates a direction from the fourth side surface 114 toward the second side surface 112. The fourth direction D4 indicates a direction opposite to the third direction D3, and indicates a direction from the second side surface 112 toward the fourth side surface 114. The first side surface 111 faces the third side surface 113 in the first direction D1.

The second side surface 112 is located between the first side surface 111 and the third side surface 113. The second side surface 112 extends along the first direction D1 and the second direction D2. The second side surface 112 faces the fourth side surface 114 in the fourth direction D4. The second liquid container portion 105 is fixed to the second side surface 112. The second side surface 112 is different from the first side surface 111. The second side surface 112 corresponds to an example of a "second surface".

The third side surface 113 faces the first side surface 111. The third side surface 113 extends along the third direction D3 and the fourth direction D4. The fourth side surface 114 faces the second side surface 112. The fourth side surface 114 extends along the first direction D1 and the second direction D2.

The second main surface 116 faces the first main surface 115 in a fifth direction D5. The fifth direction D5 indicates a direction from the second main surface 116 toward the first main surface 115. The second main surface 116 is located on a sixth direction D6 side with respect to the first main surface 115. The sixth direction D6 indicates a direction opposite to the fifth direction D5. The sixth direction D6 is along a direction in which the gravity acts.

Next, as illustrated in FIGS. 3 and 4, the main body 103 further includes the internal flow path 130. FIG. 3 illustrates the main body 103 in which a part of the first main surface 115 is omitted. FIG. 4 illustrates the main body 103 in which a part of the second main surface 116 is omitted.

The internal flow path 130 is defined by the first main surface 115, the second main surface 116, the first side surface 111, the second side surface 112, the third side surface 113, and the fourth side surface 114. The liquid passes through the internal flow path 130. The internal flow path 130 corresponds to an example of a "flow path". In other words, the first liquid container portion 101 internally includes the internal flow path 130 through which the liquid passes.

As shown in FIG. 4, the internal flow path 130 includes a first internal flow path 130*a*, a second internal flow path 130*b*, a third internal flow path 130*c*, a fourth internal flow path 130*d*, a fifth internal flow path 130*e*, a sixth internal flow path 130*f*, a seventh internal flow path 130*g*, a first opening 131, a second opening 132, and a third opening 133.

As illustrated in FIG. 3, the first opening 131 is an inlet through which liquid flows into the first internal flow path 130*a*. As illustrated in FIG. 4, the first opening 131 is a through hole penetrating in the fifth direction D5. The liquid flowing into the main body 103 from the inflow portion 121 of the linking part 102 flows into the first internal flow path 130*a* from the first opening 131. The flow of liquid from the inflow portion 121 toward the first opening 131 is a flow F11.

The first internal flow path 130*a* is connected to the first opening 131 and the second internal flow path 130*b*. The first internal flow path 130*a* is a flow path extending along the first direction D1. The liquid flowing from the first opening 131 into the first internal flow path 130*a* flows in the first direction D1. The first internal flow path 130*a* guides liquid to the second internal flow path 130*b*. The flow of the liquid in the first internal flow path 130*a* is a flow F12. The first internal flow path 130*a* is located upstream of the second internal flow path 130*b* to the seventh internal flow path 130*g*. The first internal flow path 130*a* corresponds to an example of a "second flow path".

The second internal flow path 130*b* is connected to the first internal flow path 130*a* and the third internal flow path 130*c*. The second internal flow path 130*b* is a flow path extending along the third direction D3. The liquid moved from the first internal flow path 130*a* to the second internal flow path 130*b* flows in the third direction D3. The second internal flow path 130*b* guides the liquid to the third internal flow path 130*c*. The flow of the liquid in the second internal flow path 130*b* is a flow F13. The second internal flow path 130*b* is located upstream of the third internal flow path 130*c* to the seventh internal flow path 130*g*. The second internal flow path 130*b* corresponds to an example of a "second flow path".

The third internal flow path 130*c* is connected to the second internal flow path 130*b* and the fourth internal flow path 130*d*. The third internal flow path 130*c* is a flow path extending along the first direction D1. The liquid moved from the second internal flow path 130*b* to the third internal flow path 130*c* flows in the first direction D1. The third internal flow path 130*c* guides the liquid to the fourth internal flow path 130*d*. The flow of the liquid in the third internal flow path 130*c* is a flow F14. The third internal flow path 130*c* is located upstream of the fourth internal flow path 130*d* to the sixth internal flow path 130*f*. The third internal flow path 130*c* is located downstream of the first internal flow path 130*a* and the second internal flow path 130*b*.

The third internal flow path 130*c* corresponds to a portion in contact with the heat generating component on the first main surface 115. Therefore, the third internal flow path 130*c* conducts heat to the liquid passing through the third internal flow path 130*c*. The third internal flow path 130*c* corresponds to an example of a "first flow path".

The fourth internal flow path 130*d* is connected to the third internal flow path 130*c* and the fifth internal flow path 130*e*. The fourth internal flow path 130*d* is a flow path extending along the third direction D3. The liquid moved from the third internal flow path 130*c* to the fourth internal flow path 130*d* flows in the third direction D3. The fourth internal flow path 130*d* guides the liquid to the fifth internal flow path 130*e*. The flow of the liquid in the fourth internal flow path 130*d* is a flow F16. The fourth internal flow path 130*d* is located upstream of the fifth internal flow path 130*e* to the seventh internal flow path 130*g*. The fourth internal flow path 130*d* is located downstream of the first internal flow path 130*a* to the third internal flow path 130*c*.

The fourth internal flow path 130*d* corresponds to a portion in contact with the heat generating component on the first main surface 115. Therefore, the fourth internal flow path 130*d* conducts heat to the liquid passing through the fourth internal flow path 130*d*. The fourth internal flow path 130*d* corresponds to an example of a "first flow path".

The fifth internal flow path 130*e* is connected to the fourth internal flow path 130*d*, the sixth internal flow path 130*f*, and the second opening 132. The fifth internal flow path 130*e* is a flow path extending along the second direction D2. The liquid moved from the fourth internal flow path 130*d* to the fifth internal flow path 130*e* flows in the second direction D2. The fifth internal flow path 130*e* guides the liquid to the sixth internal flow path 130*f* and the second opening 132. The flow of the liquid in the fifth internal flow path 130*e* is a flow F17. The fifth internal flow path 130*e* is located upstream of the sixth internal flow path 130*f* and the seventh internal flow path 130*g*. The fifth internal flow path 130*e* is located downstream of the first internal flow path 130*a* to the fourth internal flow path 130*d*.

The fifth internal flow path 130*e* corresponds to a portion in contact with the heat generating component on the first main surface 115. The fifth internal flow path 130*e* conducts heat to the liquid passing through the fifth internal flow path 130*e*. The fifth internal flow path 130*e* corresponds to an example of a "first flow path". In the fifth internal flow path 130*e*, a fin unit (not illustrated) may be disposed. The fin unit may have a plurality of fins. Since the fin unit has a large contact area with the liquid, heat is efficiently transferred to the liquid.

The sixth internal flow path 130*f* is connected to the fifth internal flow path 130*e* and the third opening 133. The sixth internal flow path 130*f* is a flow path extending along the fourth direction D4. The liquid moved from the fifth internal flow path 130*e* to the sixth internal flow path 130*f* flows in the fourth direction D4. The sixth internal flow path 130*f* guides the liquid to the third opening 133. The flow of the liquid in the sixth internal flow path 130*f* is a flow F18. The sixth internal flow path 130*f* is located downstream of the first internal flow path 130*a* to the fifth internal flow path 130*e*.

The seventh internal flow path 130*g* is connected to the second opening 132 and the second liquid container portion 105. The seventh internal flow path 130*g* is a flow path extending along the third direction D3. The liquid moved from the second opening 132 to the seventh internal flow path 130*g* flows in the third direction D3. The seventh internal flow path 130*g* guides the liquid to the second liquid container portion 105. The flow of the liquid in the seventh internal flow path 130*g* is a flow F19. The seventh internal flow path 130*g* is located downstream of the first internal flow path 130*a* to the fifth internal flow path 130*e*. The seventh internal flow path 130*g* corresponds to an example of a "third flow path".

The second opening 132 is an outlet through which liquid flowing through the fifth internal flow path 130*e* flows out to the seventh internal flow path 130*g*. Specifically, when the volume of the liquid increases, the liquid flows out from the fifth internal flow path 130*e* to the seventh internal flow path 130*g* through the second opening 132. That is, the second opening 132 serves as a liquid outlet.

The second opening 132 also serves as an inlet through which liquid flowing through the seventh internal flow path 130*g* flows into the fifth internal flow path 130*e*. Specifically, when the volume of the liquid decreases, the liquid flows from the seventh internal flow path 130*g* into the fifth internal flow path 130*e* through the second opening 132. That is, the second opening 132 serves as a liquid inlet. In other words, the second opening 132 allows the liquid to flow in and out.

The third opening 133 is an outlet through which liquid flowing through the sixth internal flow path 130*f* flows out to the outflow portion 122 of the linking part 102.

Figure 5:
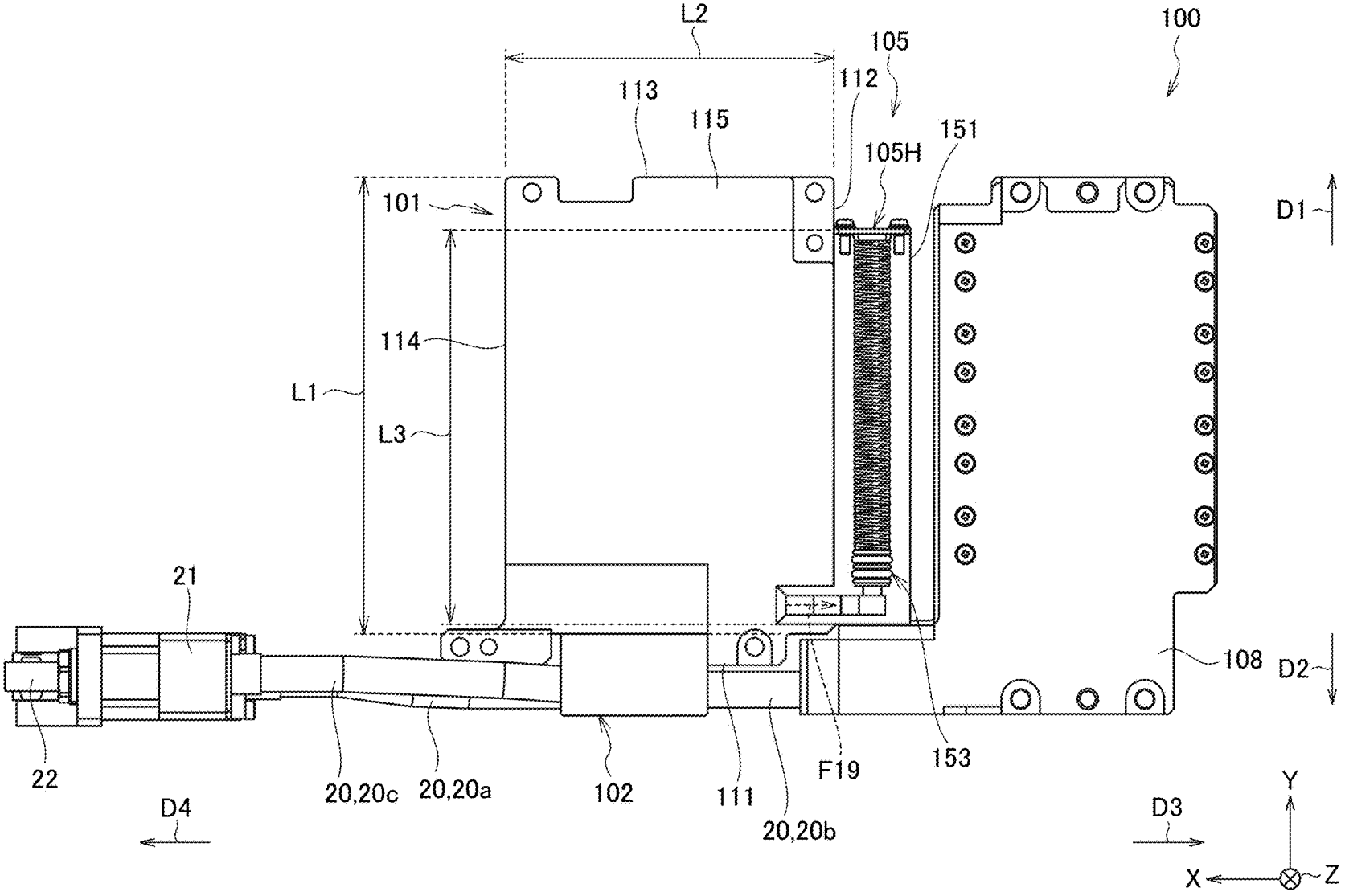
FIG. 5 illustrates the inside of a second liquid container portion according to an example embodiment of the present disclosure.
Figure 6:
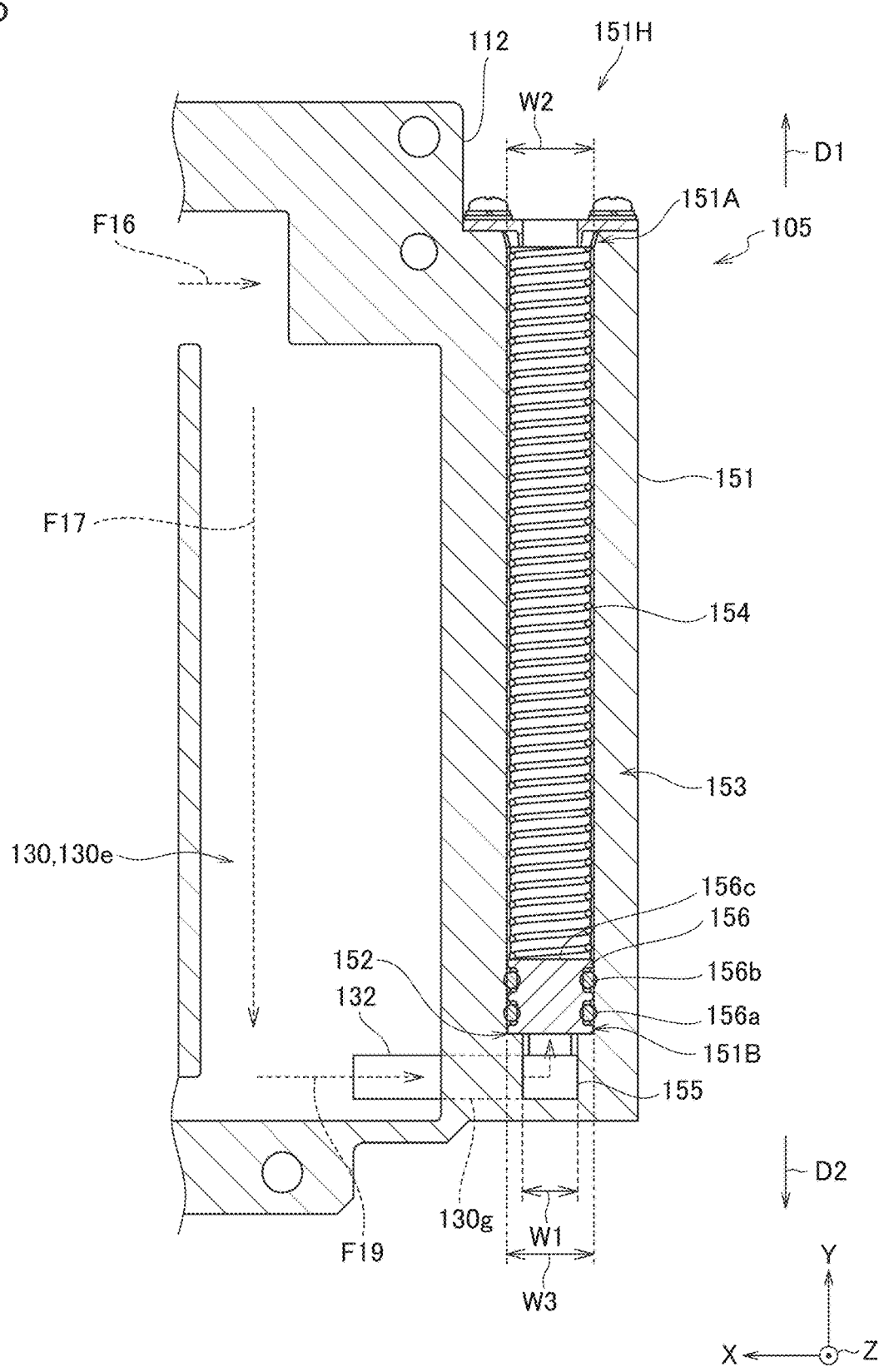
FIG. 6 schematically illustrates a cross section of the second liquid container portion before containing liquid.
Figure 7:
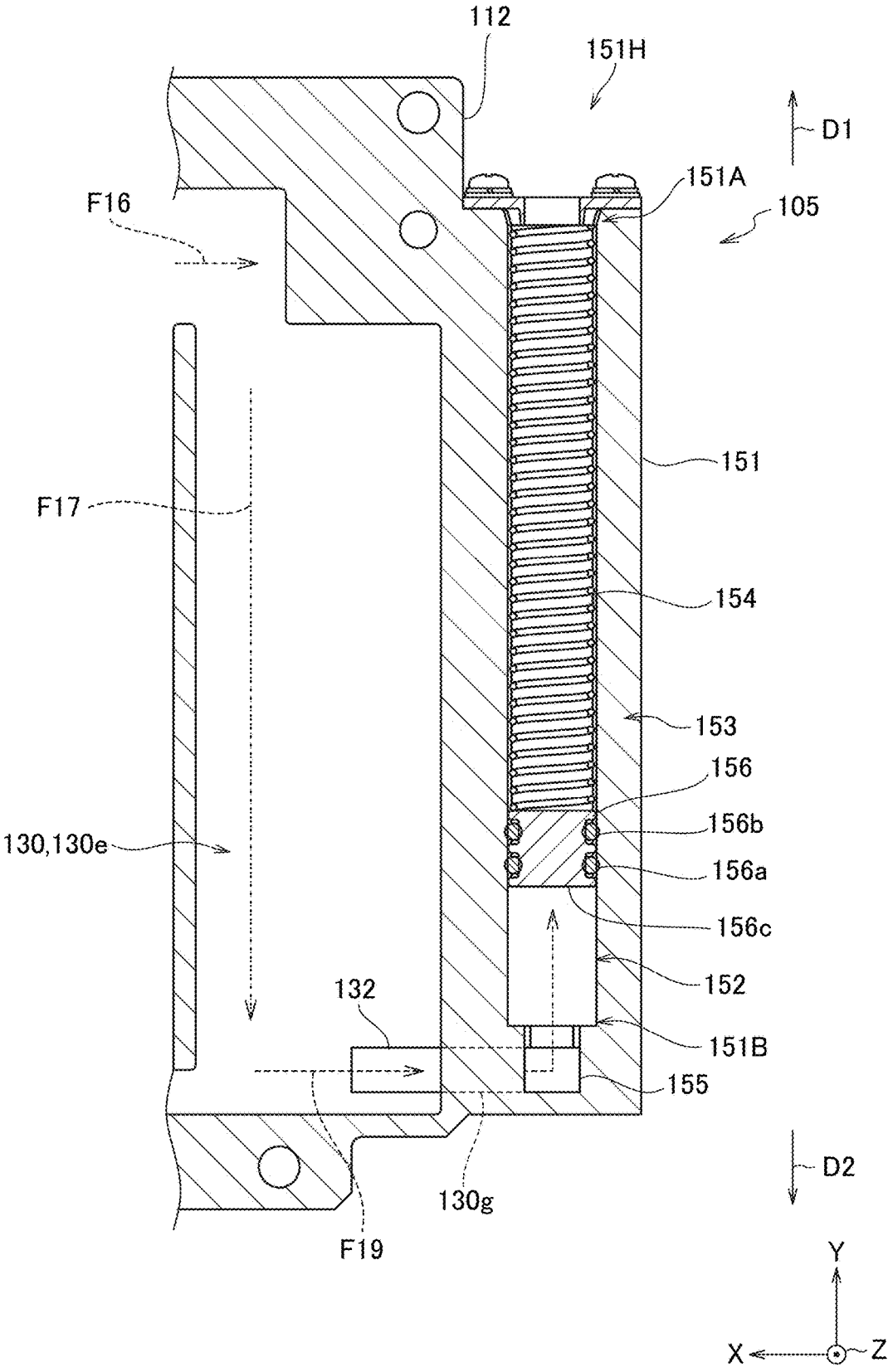
FIG. 7 schematically illustrates a cross section of the second liquid container portion when liquid is contained.

Next, the second liquid container portion 105 will be described in detail with reference to FIGS. 5 to 7. FIG. 5 illustrates the inside of the second liquid container portion 105. FIG. 6 schematically illustrates a cross section of the second liquid container portion 105 before containing liquid. FIG. 7 schematically illustrates a cross section of the second liquid container portion 105 when liquid is contained.

The second liquid container portion 105 can contain liquid. The second liquid container portion 105 is a bottomed cylindrical member whose flow path side is opened. The opening of the second liquid container portion 105 is connected to the internal flow path 130 of the first liquid container portion 101. Therefore, the liquid flows into the second liquid container portion 105 from the internal flow path 130 of the main body 103.

The second liquid container portion 105 includes a reservoir 151 and a changing assembly 153. The reservoir 151 can store the liquid in at least a part thereof. The reservoir 151 has a bottomed cylindrical shape in which the internal flow path 130 side is opened.

The changing assembly 153 changes the volume of the reservoir 151. The changing assembly 153 is disposed inside the reservoir 151. Specifically, the changing assembly 153 changes the volume of the reservoir 151 according to a change in the liquid. Therefore, the changing assembly 153 increases or decreases the volume of the reservoir 151 according to a change in the liquid. As a result, it is easy to respond to a change occurring in the liquid.

For example, since the changing assembly 153 can reduce the volume of the reservoir 151, it is possible to suppress gas from entering the inside of the cooling mechanism 10 even if the liquid decreases. Specifically, the liquid may be reduced by insertion or removal of the connector 21. In addition, for example, the liquid may evaporate from the pipe 20. In particular, when the cooling mechanism 10 is used for a long period of time, the liquid gradually evaporates from the pipe 20, and the amount of liquid circulating through the cooling mechanism 10 may decrease. According to the present example embodiment, since the changing assembly 153 can reduce the volume of the reservoir 151, it is possible to suppress gas from entering the inside of the cooling mechanism 10 even when the liquid decreases.

In addition, for example, since the changing assembly 153 can increase the volume of the reservoir 151, it is possible to reduce leakage of liquid from the inside of the cooling mechanism 10 even when the amount of injected liquid increases. Therefore, even if the liquid is excessively poured into the cooling mechanism 10 and the internal pressure in the first liquid container portion 101 increases, the changing assembly 153 increases the volume of the reservoir 151, so that it is possible to suppress the liquid from leaking from the inside of the cooling mechanism 10. For example, it is possible to omit the step of removing the liquid so that the liquid does not leak from the cooling mechanism 10 after pouring the liquid into the cooling mechanism 10.

A change in the liquid also includes the volume of the liquid that is changed as the heat of the heat generating component is conducted to the liquid. The changing assembly 153 changes the volume of the reservoir 151 according to a change in the volume of the liquid. Therefore, even if the volume of the liquid increases by the thermal expansion of the liquid due to the heat of the heat generating component, the changing assembly 153 increases the volume of the reservoir 151. As a result, even if the volume of the liquid increases and the internal pressure in the first liquid container portion 101 increases, it is possible to suppress the liquid from leaking from the cooling mechanism 10.

For example, when the temperature of the liquid increases from "25°" to "90°", the volume of the liquid increases. For example, the volume of the liquid increases by about 1.56 cc. Therefore, the changing assembly 153 increases the volume of the reservoir 151 by about 1.56 cc. That is, the changing assembly 153 increases the volume of the reservoir 151 so as to correspond to the increased volume of the liquid. Therefore, liquid leakage from the cooling mechanism 10 can be suppressed. The volume of the reservoir 151 is larger than the amount by which the volume of the liquid increases. Therefore, even if the volume of the liquid excessively changes, it is possible to suppress the liquid from leaking from the cooling mechanism 10.

Next, the second liquid container portion 105 will be described in more detail with reference to FIGS. 5 to 7. FIG. 6 is a schematic view illustrating a cross section of the second liquid container portion 105. FIG. 6 illustrates a state before the changing assembly 153 changes the volume of the reservoir 151. FIG. 7 is another view illustrating a cross section of the second liquid container portion 105. FIG. 7 illustrates a state after the changing assembly 153 changes the volume of the reservoir 151.

As illustrated in FIG. 5, the reservoir 151 of the second liquid container portion 105 extends along the first direction D1 and the second direction D2. The reservoir 151 extends along the second side surface 112. The second side surface 112 extends in the first direction D1 intersecting the direction in which the gravity acts. Therefore, as compared with the case where the reservoir extends in the sixth direction D6 which is the gravity direction, the changing assembly 153 is less likely to be affected by the gravity. As a result, the volume of the reservoir 151 can be easily changed.

As illustrated in FIG. 5, the length L1 of the second side surface 112 in the longitudinal direction is longer than the length L2 of the first side surface 111 in the longitudinal direction. The longitudinal direction of the first side surface 111 indicates a direction along the third direction D3 and the fourth direction D4. The lateral direction of the first side surface 111 indicates a direction along the fifth direction D5 and the sixth direction D6.

The length L3 of the second liquid container portion 105 in the longitudinal direction is shorter than the length L1 of the second side surface 112. The longitudinal direction of the second liquid container portion 105 and the longitudinal direction of the second side surface 112 indicate directions along the first direction D1 and the second direction D2. The lateral direction of the second liquid container portion 105 and the lateral direction of the second side surface 112 indicate directions along the fifth direction D5 and the sixth direction D6.

Therefore, the second liquid container portion 105 can be disposed on the second side surface 112 that is longer than the length L2 of the first side surface 111. As a result, the change width of the volume of the reservoir 151 can be increased. The length L3 of the second liquid container portion 105 is shorter than the length of the second side surface 112. Therefore, it is possible to suppress an increase in the length L1 of the first liquid container portion 101 in the direction along the second side surface 112. As a result, it is possible to suppress an excessive increase in size of the cold plate 100.

As illustrated in FIGS. 6 and 7, the reservoir 151 has a cylindrical shape. The reservoir 151 has a first end portion 151A and a second end portion 151B.

The first end portion 151A is an end portion on the first direction D1 side. The first end portion 151A corresponds to an example of a "bottom portion". The first end portion 151A has a through hole 151H. That is, the first end portion 151A has a hole. The through hole 151H allows the outside and the inside of the reservoir 151 to communicate with each other. Therefore, the air in the reservoir 151 passes through the through hole 151H and is released to the atmosphere. In other words, the bottom portion of the second liquid container portion 105 has a hole. That is, when the changing assembly 153 changes the volume of the reservoir 151, the air in the second liquid container portion 105 is released from the through hole 151H to the atmosphere. Therefore, when the volume of the reservoir 151 is changed, it is possible to suppress the air in the second liquid container portion 105 from hindering the operation of the changing assembly 153. Specifically, when the changing assembly 153 changes the volume of the reservoir 151, the air in the reservoir 151 is released to the atmosphere. Therefore, when the volume of the reservoir 151 is changed, it is possible to suppress the air in the reservoir 151 from hindering the operation of the changing assembly 153. As a result, the volume of the reservoir 151 can be smoothly changed.

The second end portion 151B is an end portion on the second direction D2 side. The second end portion 151B opens in the second direction D2. The second end portion 151B corresponds to an example of an "opening portion". The second end portion 151B is connected to the internal flow path 130 located on the second side surface 112 side.

Therefore, the reservoir 151 can be attached to a surface different from the surface on which the inflow portion 121 into which the liquid flows and the outflow portion 122 out of which the liquid flows are disposed. As a result, it is possible to reduce hindrance of the flow of the liquid flowing into the main body 103 and to reduce hindrance of the flow of the liquid flowing out of the main body 103.

As illustrated in FIGS. 6 and 7, the changing assembly 153 changes the volume of the reservoir portion 152 capable of storing the liquid in the reservoir 151. That is, the changing assembly 153 decreases the volume of the reservoir portion 152 in accordance with the decrease in the volume of the liquid. As a result, it is possible to suppress gas from entering the cooling mechanism 10. Further, the changing assembly 153 increases the volume of the reservoir portion 152 in accordance with the increase in the volume of the liquid. As a result, it is possible to suppress leakage of the liquid from the cooling mechanism 10 due to an increase in the internal pressure.

Although the cold plate 100 and the liquid feeder 200 can be inserted into and removed from the radiator 30 or the flow path, it is difficult to insert the cold plate 100 or the liquid feeder 200 particularly in a state where the internal pressure of the cooling mechanism 10 is increased. However, in the present example embodiment in which the second liquid container portion 105 is provided in the cold plate 100 or the liquid feeder 200, it is possible to suppress an increase in the internal pressure of the cooling mechanism 10. Therefore, it is possible to suppress deterioration of workability of insertion and removal with the cold plate 100 and the liquid feeder 200.

In addition, for example, when the cold plate 100 is removed in a state where the internal pressure of the cooling mechanism 10 is high, pressure is applied to the connector 21, and the liquid may leak. However, in the present example embodiment in which the second liquid container portion 105 is provided in the cold plate 100 or the liquid feeder 200, it is possible to suppress an increase in the internal pressure of the cooling mechanism 10. Therefore, it is possible to suppress continuous pressure from being applied to the connector 21 and to suppress liquid leakage.

The changing assembly 153 includes a sealing portion 156 and a moving portion 154.

The sealing portion 156 is disposed inside the reservoir 151. The sealing portion 156 seals the liquid in the reservoir 151. The sealing portion 156 prevents the liquid flowing into the reservoir portion 152 from moving to the through hole 151H side beyond the sealing portion 156.

In the present example embodiment, the sealing portion 156 is disposed on the second end portion 151B side of the reservoir 151. The liquid can be contained in at least a part of the reservoir 151 by the sealing portion 156. That is, as shown in FIG. 7, the liquid can be contained in the reservoir portion 152 of the reservoir 151 by the sealing portion 156. As a result, in the reservoir 151, the liquid is contained on the side opposite to the moving portion 154 with the sealing portion 156 as a boundary.

The sealing portion 156 includes a first sealing portion 156*a*, a second sealing portion 156*b*, and a main body portion 156*c*. The main body portion 156*c* is disposed inside the reservoir 151. The main body portion 156*c* has a columnar shape. The main body portion 156*c* faces the inner surface of the reservoir 151 in the third direction D3 or the fourth direction D4. That is, the outer peripheral surface of the main body portion 156*c* faces the inner surface of the reservoir 151 on the radially outer side of the main body portion 156*c*.

The main body portion 156*c* has a plurality of grooves. The plurality of grooves are recessed radially inward of the main body portion 156*c* from the outer peripheral surface of the main body portion 156*c*. A lubricant may be applied to the plurality of grooves. Specifically, the plurality of grooves is a lubricant reservoir. That is, the plurality of grooves can reserve the lubricant.

The lubricant is, for example, white petrolatum. The lubricant may be microcrystalline wax, paraffin wax, silicone oil, fluorine oil, polyalkylene glycol, mineral oil, or liquid paraffin. These may be used singly or in combination of two or more kinds thereof.

The first sealing portion 156*a* and the second sealing portion 156*b* seal a gap between the reservoir 151 and the main body portion 156*c*. That is, the first sealing portion 156*a* and the second sealing portion 156*b* are positioned between the reservoir 151 and the main body portion 156*c*. The first sealing portion 156*a* is located closer to the second direction D2 than the second sealing portion 156*b* is. The first sealing portion 156*a* is disposed in a groove located on the second direction D2 side among the plurality of grooves of the main body portion 156*c*. The second sealing portion 156*b* is located closer to the first direction D1 side than the first sealing portion 156*a* is. The second sealing portion 156*b* is disposed in a groove located on the first direction D1 side among the plurality of grooves of the main body portion 156*c*.

The first sealing portion 156*a* and the second sealing portion 156*b* are formed of elastic members. For example, the first sealing portion 156*a* and the second sealing portion 156*b* are annular elastic members. The annular elastic member is, for example, natural rubber or synthetic rubber. The synthetic rubber includes nitrile rubber (NBR), urethane rubber (U), fluororubber (FKM), tetrafluoroethylene resin (PTFE), hydrogenated nitrile rubber (HNBR), silicone rubber (Q), ethylene propylene rubber (EPDM), chloroprene rubber (CR), acrylic rubber (ACM), epichlorohydrin rubber (ECO), or butyl rubber (IIR).

The moving portion 154 moves the sealing portion 156 along the direction in which the reservoir 151 extends. The moving portion 154 moves the sealing portion 156 close to or away from the second end portion 151B according to a change in volume of the liquid. For example, when the volume of the liquid decreases, the moving portion 154 brings the sealing portion 156 close to the second end portion 151B. Therefore, the volume of the reservoir portion 152 of the reservoir 151 is reduced. For example, when the volume of the liquid increases, the sealing portion 156 is separated from the second end portion 151B. Therefore, the volume of the reservoir portion 152 of the reservoir 151 increases. As a result, the volume of the reservoir portion 152 of the reservoir 151 can be changed with a simple configuration.

For example, as illustrated in FIG. 6, the moving portion 154 moves the sealing portion 156 toward the second direction D2. Specifically, the moving portion 154 moves the sealing portion 156 toward the second direction D2 until the sealing portion 156 reaches the second end portion 151B. Therefore, the sealing portion 156 approaches the second end portion 151B, and the volume of the reservoir portion 152 decreases. That is, the amount of liquid that can be contained is reduced.

For example, as illustrated in FIG. 7, when the liquid is contained in the reservoir portion 152, the liquid moves the sealing portion 156 in the first direction D1. At this time, the moving portion 154 is pressed toward the first direction D1 by the sealing portion 156 according to the amount of liquid contained in the reservoir portion 152. Therefore, the sealing portion 156 is separated from the second end portion 151B, and the volume of the reservoir portion 152 increases. That is, the amount of liquid that can be contained is increased.

The moving portion 154 includes a spring. Specifically, the moving portion 154 is a compression coil spring. Therefore, the compression coil spring is accommodated in the reservoir 151 in a compressed state. That is, the length of the moving portion 154 before being accommodated in the reservoir 151 is longer than the length of the reservoir 151 along the first direction D1. In other words, the length of the spring when not contracted is longer than the length from the second end portion 151B to the first end portion 151A of the reservoir 151. Therefore, by using a relatively inexpensive spring as the moving portion 154, the sealing portion 156 can be easily moved.

The spring is disposed between the first end portion 151A and the sealing portion 156. Therefore, since the sealing portion 156 is disposed in the vicinity of the second end portion 151B, the speed corresponding to an increase in the internal pressure of the main body portion 156*c* caused by an increase in the volume of the liquid increases. As a result, it is possible to further suppress the liquid from leaking from the cooling mechanism 10.

The second liquid container portion 105 further includes a connecting portion 155. The connecting portion 155 connects the reservoir 151 and the internal flow path 130. Specifically, as shown in FIGS. 6 and 7, the connecting portion 155 connects the opening of the second end portion 151B of the reservoir 151 and the seventh internal flow path 130*g*. Therefore, the second liquid container portion 105 is connected to the seventh internal flow path 130*g* through which the liquid having a volume increased by heat reception passes. That is, the second liquid container portion 105 can be disposed at a place where a change in the volume of the liquid becomes large. As a result, it is easier to cope with a change in the volume of the liquid.

The connecting portion 155 has a cylindrical shape. An inner diameter W1 of the connecting portion 155 is smaller than an inner diameter W2 of the reservoir 151. An outer diameter W3 of the sealing portion 156 is smaller than an inner diameter W2 of the reservoir 151. Further, the outer diameter W3 of the sealing portion 156 is larger than the inner diameter W1 of the connecting portion 155. Therefore, the connecting portion 155 can suppress the movement of the sealing portion 156 in the second direction D2. As a result, the sealing portion 156 can be prevented from moving to the inside of the connecting portion 155.

In addition, a lubricant is applied to the inner surface of the reservoir 151 of the present example embodiment. Therefore, it is possible to easily move the sealing portion 156 by the change in the volume of the liquid.

In the present example embodiment, the second liquid container portion 105 is fixed to the second side surface 112 so as to cross the seventh internal flow path 130*g*, but the present disclosure is not limited thereto. The second liquid container portion 105 may be fixed in a direction along the seventh internal flow path 130*g*.

Figure 8:
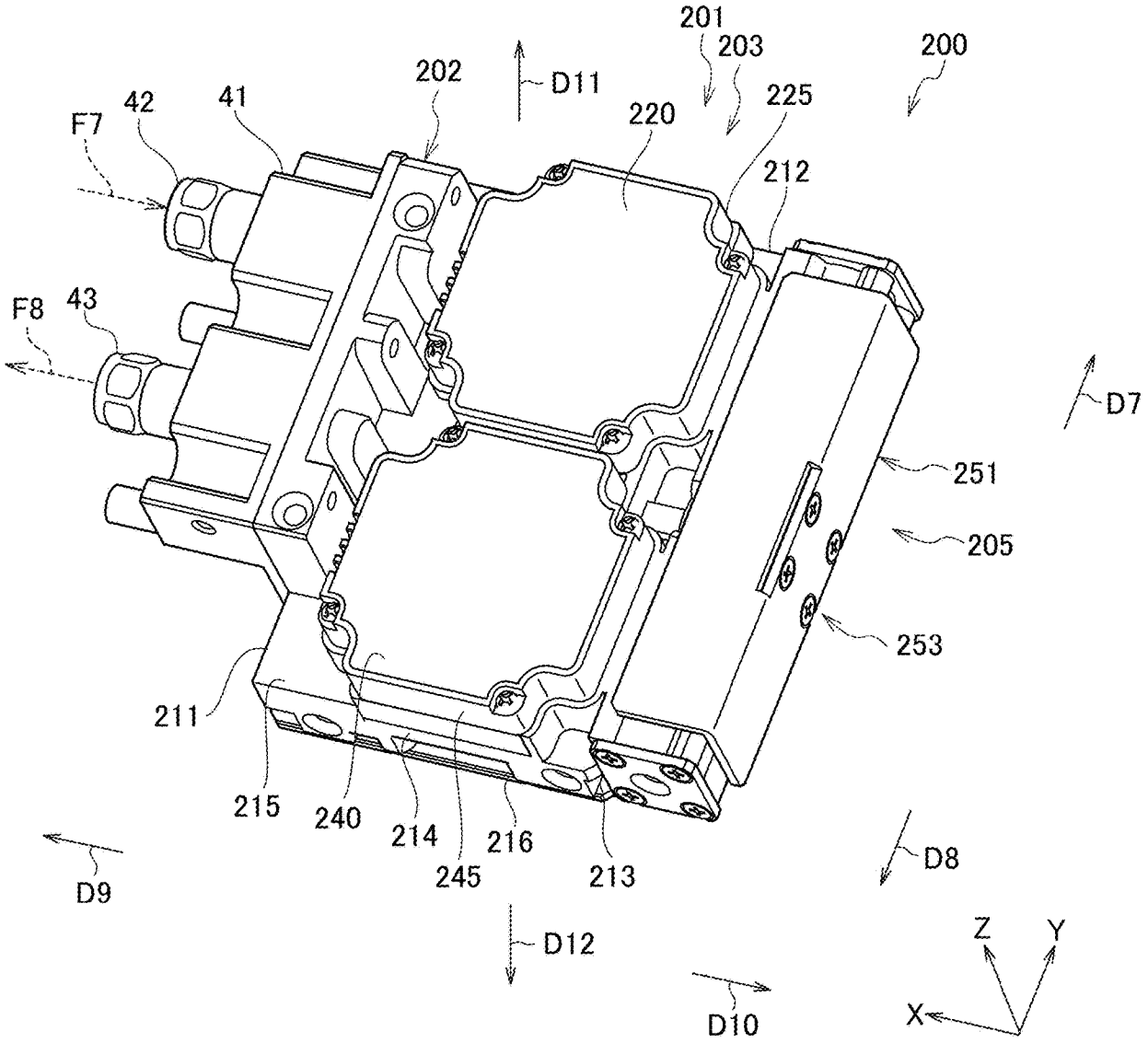
FIG. 8 is a perspective view of a liquid feeder according to an example embodiment of the present disclosure.
Figure 9:
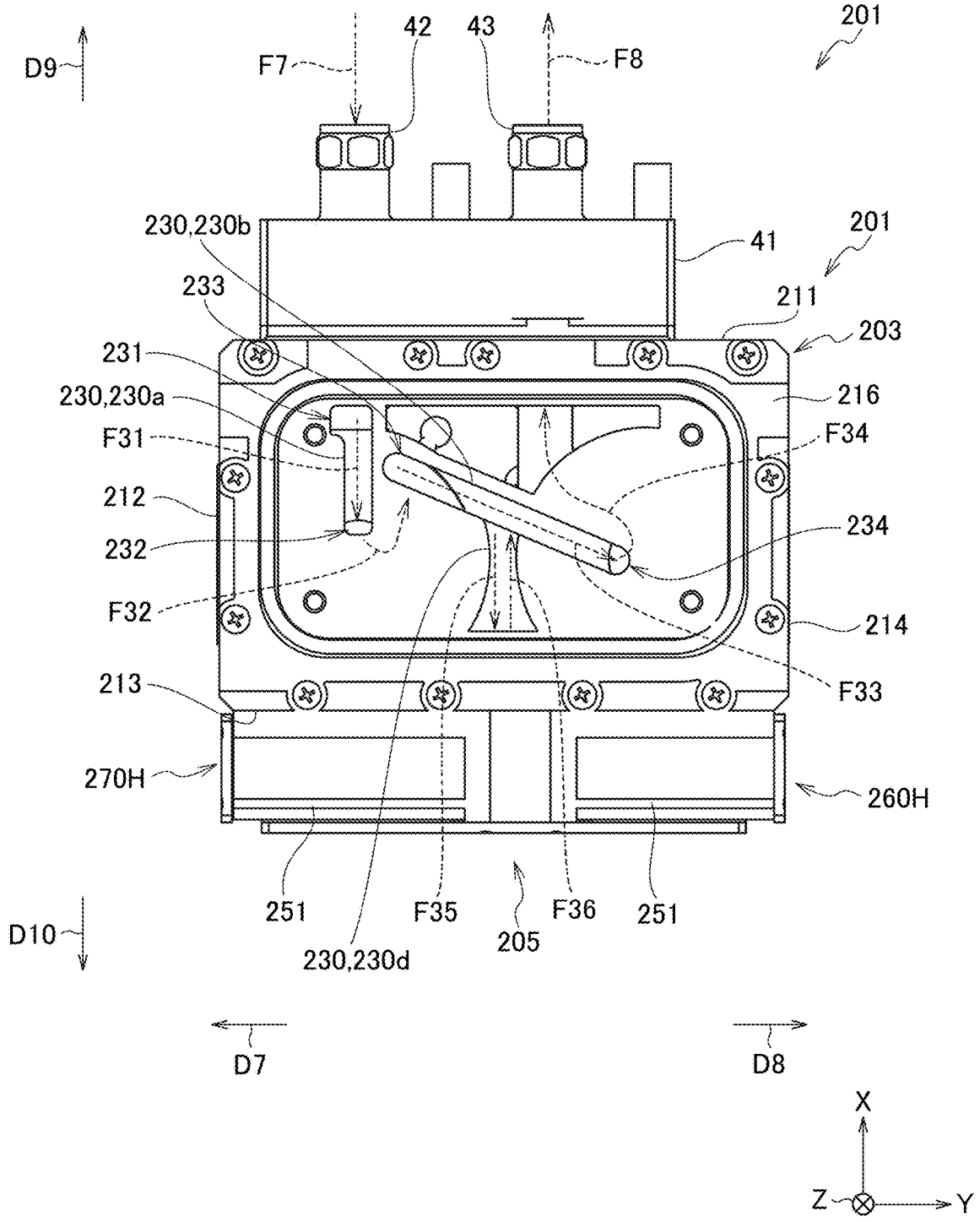
FIG. 9 is a diagram illustrating an internal flow path of the liquid feeder.
Figure 10:
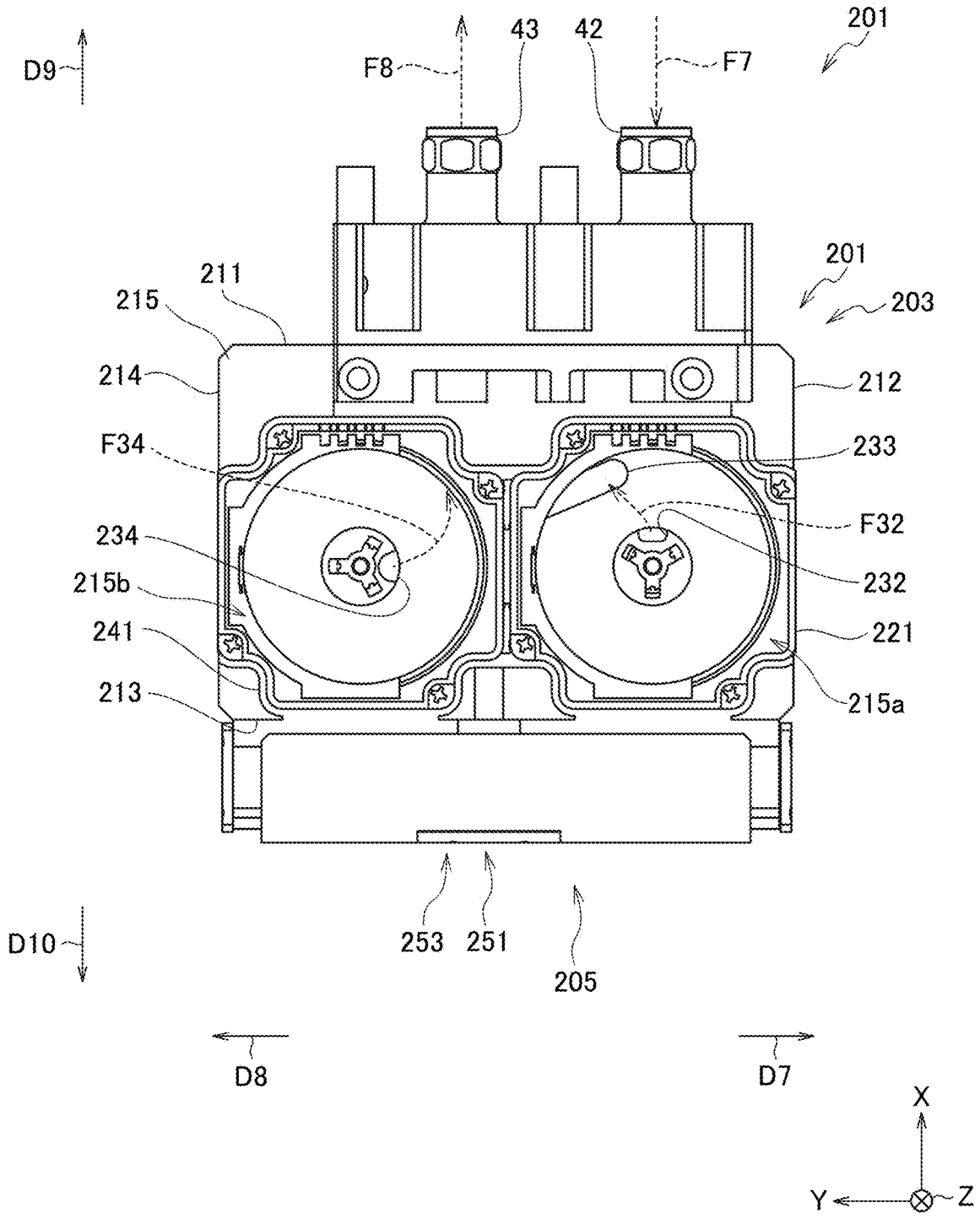
FIG. 10 is another diagram illustrating the internal flow path of the liquid feeder.
Figure 11:
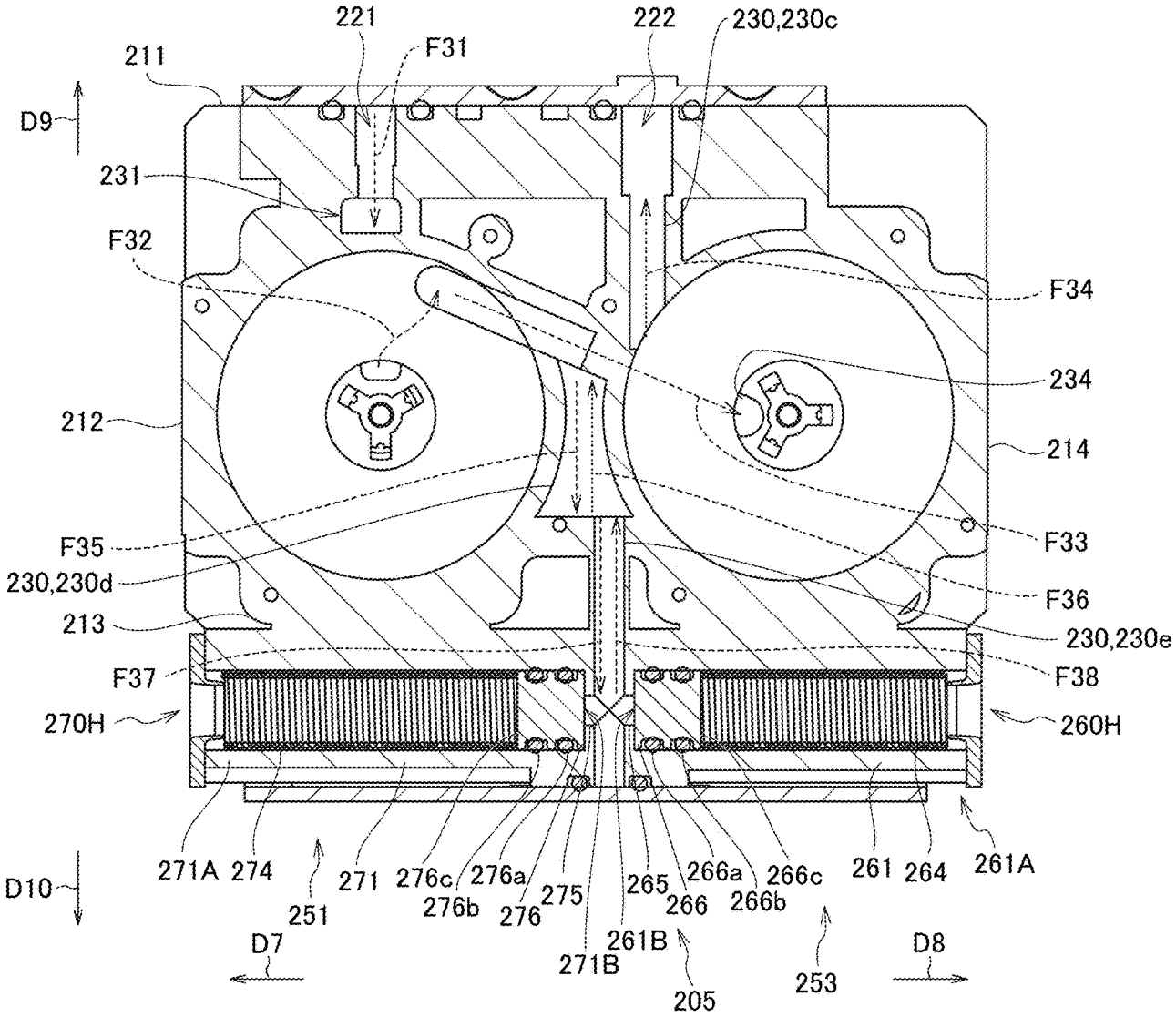
FIG. 11 is a diagram illustrating a cross section of the liquid feeder.
Figure 12:
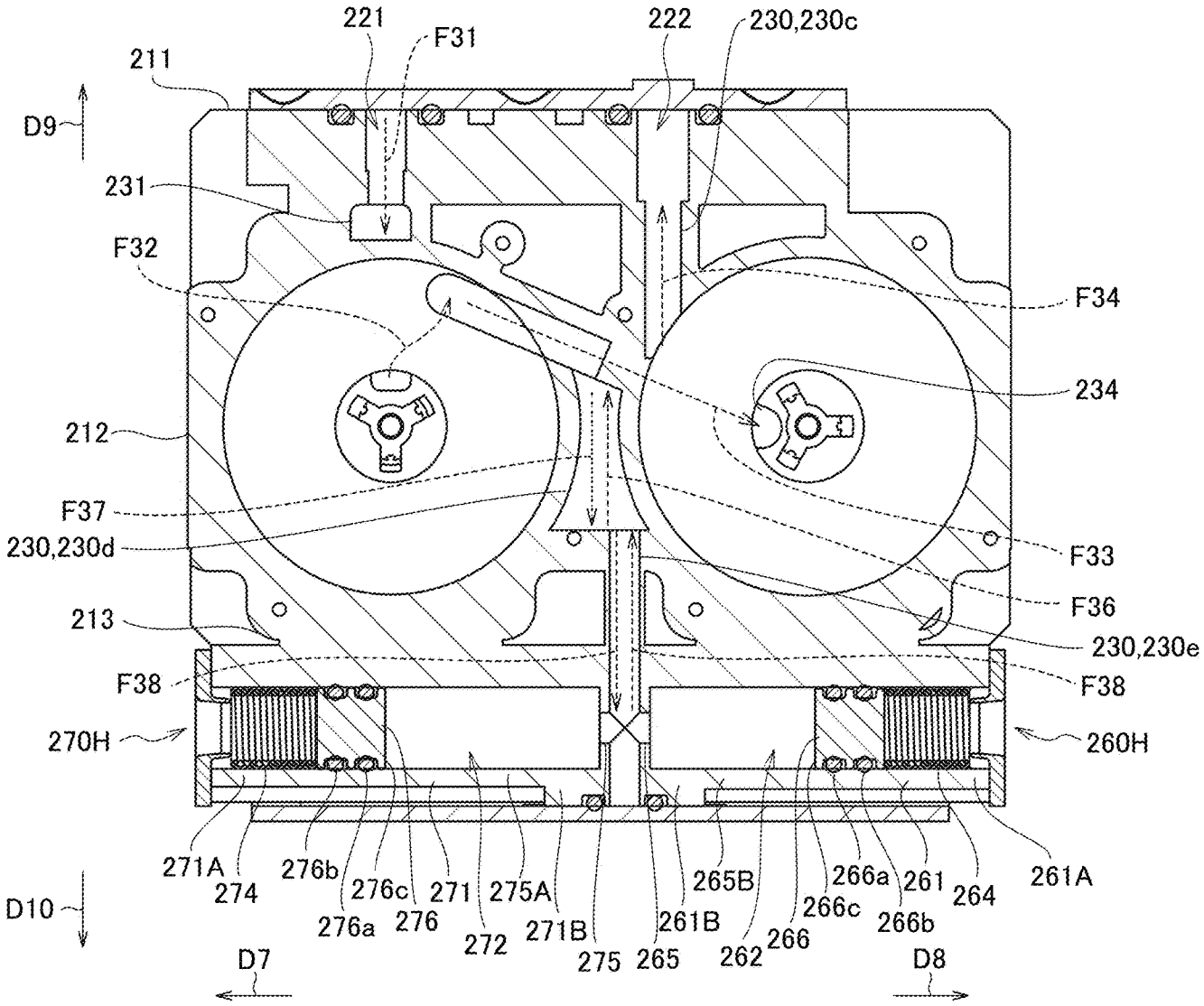
FIG. 12 is another diagram illustrating a cross section of the liquid feeder.

Next, the liquid feeder 200 will be described in more detail with reference to FIGS. 8 to 12. FIG. 8 is a perspective view illustrating the liquid feeder 200. FIG. 9 is a diagram illustrating the internal flow path 230 of the liquid feeder 200. FIG. 10 is another diagram illustrating the internal flow path 230 of the liquid feeder 200. FIG. 11 is a diagram illustrating a cross section of the liquid feeder 200. FIG. 12 is another diagram illustrating a cross section of the liquid feeder 200.

The cooling mechanism 10 further includes a connector 41. The connector 41 connects the radiator 30 and the liquid feeder 200. As illustrated in FIG. 8, the connector 41 includes a third connecting portion 42 and a fourth connecting portion 43.

The third connecting portion 42 connects the radiator 30 and the liquid feeder 200. The liquid flows from the radiator 30 to the liquid feeder 200 by the third connecting portion 42. The flow of liquid from the radiator 30 toward the liquid feeder 200 is a flow F7. The liquid flows into the liquid feeder 200 from the radiator 30 by the third connecting portion 42.

The fourth connecting portion 43 connects the liquid feeder 200 and the radiator 30. The liquid flows from the liquid feeder 200 to the radiator 30 by the fourth connecting portion 43. The flow of the liquid from the liquid feeder 200 toward the radiator 30 is a flow F8. The liquid flows out from the liquid feeder 200 to the radiator 30 by the fourth connecting portion 43.

The liquid feeder 200 can contain liquid. The liquid feeder 200 corresponds to an example of a "container". The liquid feeder 200 includes a fifth liquid container portion 201, a sixth liquid container portion 205, a first pump 240, and a second pump 220.

The liquid passes through each of the fifth liquid container portion 201 and the sixth liquid container portion 205. The fifth liquid container portion 201 corresponds to an example of a "first container portion". The sixth liquid container portion 205 corresponds to an example of a "second container portion".

The fifth liquid container portion 201 includes a linking part 202 and a main body 203. The linking part 202 is connected to the connector 41. As illustrated in FIG. 11, the linking part 202 includes an inflow portion 221 and an outflow portion 222.

The inflow portion 221 allows the liquid having passed through the third connecting portion 42 to flow into the main body 203. The inflow portion 221 has a through hole penetrating from the connection portion of the third connecting portion 42 toward the inside of the main body 203. Therefore, as in a flow F31 illustrated in FIG. 11, the liquid moving in the third connecting portion 42 flows into the main body 203 via the inflow portion 221.

The outflow portion 222 allows the liquid to flow out of the main body 203 to the fourth connecting portion 43. The outflow portion 222 has a through hole penetrating from the main body 203 toward the connection portion of the fourth connecting portion 43. Therefore, as in a flow F34 from the outflow portion 222 illustrated in FIG. 11, the liquid flows out of the main body 203 to the fourth connecting portion 43.

The main body 203 includes the internal flow path 230, a first attachment portion 215*a*, and a second attachment portion 215*b*. The liquid passes through the internal flow path 230. The internal flow path 230 corresponds to an example of a "flow path".

The first pump 240 is attached to the first attachment portion 215*a*. Specifically, the first attachment portion 215*a* is recessed inside the main body 203. Therefore, the first pump 240 is fitted into the first attachment portion 215*a*. The first attachment portion 215*a* is connected to the internal flow path 230 of the main body 203. Therefore, liquid flows into the first attachment portion 215*a*.

The second pump 220 is attached to the second attachment portion 215*b*. Specifically, the second attachment portion 215*b* is recessed inside the main body 203. Therefore, the second pump 220 is fitted into the second attachment portion 215*b*. The second attachment portion 215*b* is connected to the internal flow path 230 of the main body 203. Therefore, liquid flows into the second attachment portion 215*b*.

The main body 203 further includes a plurality of surfaces. The plurality of surfaces of the main body 203 include a first main surface 215, a second main surface 216, a first side surface 211, a second side surface 212, a third side surface 213, and a fourth side surface 214.

In the first main surface 215, the first attachment portion 215*a* and the second attachment portion 215*b* are positioned. Therefore, the first pump 240 and the second pump 220 are disposed on the first main surface 215. The first main surface 215 is located on a tenth direction D10 side of the linking part 202. The tenth direction D10 indicates a direction from the linking part 202 toward the main body 203. The linking part 202 is located on a ninth direction D9 side of the first main surface 115. The ninth direction D9 indicates a direction opposite to the tenth direction D10.

The linking part 202 is fixed to the first side surface 211. That is, the inflow portion 221 and the outflow portion 222 are disposed on the first side surface 211. The first side surface 211 corresponds to an example of a "first surface". The first side surface 211 is located between the second side surface 212 and the fourth side surface 214. The first side surface 211 extends along the seventh direction D7 and the eighth direction D8. The seventh direction D7 indicates a direction from the fourth side surface 214 toward the second side surface 212. The eighth direction D8 indicates a direction opposite to the seventh direction D7, and indicates a direction from the second side surface 212 toward the fourth side surface 214. The seventh direction D7 and the eighth direction D8 are directions intersecting the direction in which the gravity acts. The first side surface 211 faces the third side surface 213 in the tenth direction D10.

The second side surface 212 is located between the first side surface 211 and the third side surface 213. The second side surface 212 extends along the tenth direction D10 and the ninth direction D9. The second side surface 212 faces the fourth side surface 214 in the eighth direction D8.

The third side surface 213 faces the first side surface 211. The third side surface 213 extends along the seventh direction D7 and the eighth direction D8. The sixth liquid container portion 205 is located on the third side surface 213. The third side surface 213 is different from the first side surface 211. The third side surface 213 corresponds to an example of a "second surface".

The fourth side surface 214 faces the second side surface 112. The fourth side surface 214 extends along the seventh direction D7 and the eighth direction D8.

The second main surface 216 faces the first main surface 215 in an eleventh direction D11. The eleventh direction D11 indicates a direction from the second main surface 216 toward the first main surface 215. The second main surface 216 is located closer to a twelfth direction D12 than the first main surface 215. The twelfth direction D12 indicates a direction opposite to the eleventh direction D11. The twelfth direction D12 is along a direction in which the gravity acts.

The first pump 240 delivers the liquid to the outflow portion 222. As illustrated in FIGS. 8 and 10, the first pump 240 includes a casing 245, an impeller (not illustrated), a pump rotation shaft (not illustrated), and a motor (not illustrated). The pump rotation shaft (not shown) is disposed on the second attachment portion 215*b*. The impeller (not shown) is supported by the pump rotation shaft (not shown), and when the pump rotation shaft (not shown) rotates about the axis, the impeller (not shown) rotates. The motor rotates the impeller (not shown) about the pump rotation shaft (not shown).

The second pump 220 delivers the liquid flowing in from the inflow portion 221, to the first pump 240. As illustrated in FIGS. 8 and 10, the second pump 220 includes a casing 225, an impeller (not illustrated), a pump rotation shaft (not illustrated), and a motor (not illustrated). The pump rotation shaft (not shown) is disposed on the first attachment portion 215*a*. The impeller (not shown) is supported by the pump rotation shaft (not shown), and when the pump rotation shaft (not shown) rotates about the axis, the impeller (not shown) rotates. The motor rotates the impeller (not shown) about the pump rotation shaft (not shown).

The first pump 240 and the second pump 220 are disposed between the first side surface 211 and the sixth liquid container portion 205. The first pump 240 and the second pump 220 are adjacent to each other in the direction in which the first side surface 211 extends. Specifically, the first pump 240 and the second pump 220 are adjacent to each other in the longitudinal direction of the first side surface 211. The longitudinal direction of the first side surface 211 indicates a direction along the seventh direction D7 and the eighth direction D8. Therefore, it is possible to prevent the liquid feeder 200 from becoming excessively large while securing the arrangement positions of the first pump 240 and the second pump 220. As a result, the degree of freedom of installation of the liquid feeder 200 can be improved.

The first pump 240 and the second pump 220 are connected in series by an internal flow path 230. Therefore, even when one of the pumps is stopped, it is possible to prevent the liquid from flowing back in the internal flow path 230.

Next, the flow of liquid in the internal flow path 230 of the main body 203 will be described in detail with reference to FIGS. 9 to 12. In FIG. 9, the main body 203 in which the second main surface 216 is omitted is illustrated. FIG. 10 illustrates the main body 203 in which a part of the first pump 240 and a part of the second pump 220 are omitted. Each of the first pump 240 and the second pump 220 is in a state of sending out liquid.

The internal flow path 230 is defined by the first main surface 215, the second main surface 216, the first side surface 211, the second side surface 212, the third side surface 213, and the fourth side surface 214. In other words, the fifth liquid container portion 201 internally includes the internal flow path 230 through which the liquid passes.

As shown in FIGS. 9 to 11, the internal flow path 230 includes a first internal flow path 230*a*, a second internal flow path 230*b*, a third internal flow path 230*c*, a fourth internal flow path 230*d*, a fifth internal flow path 230*e*, a first opening 231, a second opening 232, a third opening 233, and a fourth opening 234.

As illustrated in FIG. 9, the first opening 231 is an inlet through which the liquid flows into the first internal flow path 230*a*. As illustrated in FIG. 9, the first opening 231 opens in the twelfth direction D12. The liquid flowing into the main body 203 from the inflow portion 221 of the linking part 202 flows into the first internal flow path 230*a* from the first opening 231.

As illustrated in FIG. 9, the first internal flow path 230*a* is connected to the first opening 231 and the second opening 232. The first internal flow path 230*a* is a flow path extending along the tenth direction D10. The liquid flowing from the first opening 231 into the first internal flow path 230*a* flows in the tenth direction D10. The first internal flow path 230*a* guides the liquid to the second opening 232. The flow of liquid from the inflow portion 221 toward the first opening 231 and the flow of liquid in the first internal flow path 130*a* are a flow F31.

As shown in FIGS. 9 and 10, the second opening 232 allows the first internal flow path 230*a* and the first attachment portion 215*a* to communicate with each other. The second opening 232 opens in the eleventh direction D11. The liquid passes through the second opening 232 and moves from the first internal flow path 230*a* to the inside of the first attachment portion 215*a*. That is, the second opening 232 is an inlet through which liquid flows into the first attachment portion 215*a*. The flow of liquid from the second opening 232 toward the third opening 233 via the first attachment portion 215*a* is a flow F32.

The third opening 233 allows the first attachment portion 215*a* and the second internal flow path 230*b* to communicate with each other. The third opening 233 opens in the twelfth direction D12. The liquid passes through the third opening 233 and moves to the second internal flow path 230*b*. That is, the third opening 233 is an inlet through which liquid flows into the second internal flow path 230*b*.

The second internal flow path 230*b* connects the first attachment portion 215*a* and the second attachment portion 215*b*. The second internal flow path 230*b* corresponds to an example of a "connection flow path". Therefore, the second internal flow path 230*b* is connected to the sixth liquid container portion 205. As a result, the first pump 240 and the second pump 220 are hardly affected by the inflow and outflow of the liquid due to the change in the volume of the sixth liquid container portion 205.

Specifically, the second internal flow path 230*b* is connected to the third opening 233 and the fourth opening 234. The second internal flow path 230*b* is a flow path extending along the eighth direction D8. The liquid flowing from the third opening 2313 into the second internal flow path 230*b* flows in the direction along the eighth direction D8. The second internal flow path 230*b* guides the liquid to the third opening 233. The flow of liquid from the third opening 233 toward the fourth opening 234 is a flow F33.

The fourth opening 234 allows the second internal flow path 230*b* and the second attachment portion 215*b* to communicate with each other. The fourth opening 234 opens in the eleventh direction D11. The liquid passes through the fourth opening 234 and moves into the second attachment portion 215*b*. That is, the fourth opening 234 is an inlet through which liquid flows into the second attachment portion 215*b*.

As shown in FIG. 11, the third internal flow path 230*c* is connected to the second attachment portion 215*b* and the outflow portion 222. The third internal flow path 230*c* is a flow path extending along the ninth direction D9. The liquid moved to the second attachment portion 215*b* flows in the ninth direction D9. The third internal flow path 230*c* guides liquid to the outflow portion 222. The flow of the liquid in the third internal flow path 230*c* is a flow F34. Therefore, the liquid passes through the third internal flow path 230*c* and flows from the outflow portion 222 to the radiator 30.

The fourth internal flow path 230*d* is connected to the second internal flow path 230*b* and the fifth internal flow path 230*e*. The fourth internal flow path 230*d* is a flow path extending along the tenth direction D10. The fourth internal flow path 230*d* is connected so as to cross the second internal flow path 230*b*. Further, the second internal flow path 230*b* is connected to an intermediate portion of the fourth internal flow path 230*d*. That is, the fourth internal flow path 230*d* is positioned between the third opening 233 and the fourth opening 234. In the fourth internal flow path 230*d*, a flow F35 flowing in the tenth direction D10 and a flow F36 flowing in the ninth direction D9 pass. The fourth internal flow path 230*d* may have a reservoir that stores liquid.

The fifth internal flow path 230*e* is connected to the fourth internal flow path 230*d* and the sixth liquid container portion 205. The fifth internal flow path 230*e* extends along the tenth direction D10. In the fifth internal flow path 230*e*, a flow F37 flowing in the tenth direction D10 and a flow F38 flowing in the ninth direction D9 pass. The flow F37 is a flow of liquid flowing into the sixth liquid container portion 205. The flow F38 is a flow of liquid flowing out of the sixth liquid container portion 205.

Next, the sixth liquid container portion 205 will be described in detail with reference to FIGS. 11 and 12.

The sixth liquid container portion 205 can contain liquid. The sixth liquid container portion 205 is a bottomed cylindrical member whose flow path side is opened. The opening of the sixth liquid container portion 205 is connected to the internal flow path 230 of the fifth liquid container portion 201. Specifically, the sixth liquid container portion 205 is connected to the second internal flow path 230*b*. Therefore, the liquid flows into the sixth liquid container portion 205 from the internal flow path 230 of the main body 203.

Specifically, the sixth liquid container portion 205 is connected to the second internal flow path 230*b* via the fourth internal flow path 230*d* and the fifth internal flow path 230*e*.

The sixth liquid container portion 205 includes a reservoir 251 and a changing assembly 253. The reservoir 251 can store liquid in at least a part thereof. The reservoir 251 has a bottomed cylindrical shape in which the internal flow path 230 side is opened.

The changing assembly 253 changes the volume of the reservoir 251. Specifically, the changing assembly 253 changes the volume of the reservoir 251 according to a change in the liquid. Therefore, the changing assembly 253 increases or decreases the volume of the reservoir 251 according to a change in the liquid. As a result, it is possible to suppress the gas from entering the inside of the cooling mechanism 10 and to suppress the liquid from leaking from the cooling mechanism 10 due to the change in the liquid.

The changing assembly 253 changes the volume of the reservoir 251 according to a change in the volume of the liquid. Therefore, even if the volume of the liquid increases by the thermal expansion of the liquid due to the heat of the heat generating component, the changing assembly 253 increases the volume of the reservoir 251. As a result, even if the volume of the liquid increases and the internal pressure in the fifth liquid container portion 201 increases, it is possible to suppress the liquid from leaking from the cooling mechanism 10.

The reservoir 251 includes a first reservoir 261 and a second reservoir 271.

The first reservoir 261 is located on the eighth direction D8 side with respect to the second reservoir 271. The first reservoir 261 can store liquid in at least a part thereof.

The first reservoir 261 has a cylindrical shape. The first reservoir 261 has a first end portion 261A and a second end portion 261B.

The first end portion 261A is an end portion on the eighth direction D8 side. The first end portion 261A corresponds to an example of a "bottom portion". The first end portion 261A has a through hole 260H. The through hole 260H allows the outside and the inside of the first reservoir 261 to communicate with each other. Therefore, the air in the first reservoir 261 passes through the through hole 260H and is released to the atmosphere.

The second end portion 261B is an end portion on the seventh direction D7 side. The second end portion 261B opens in the seventh direction D7. The second end portion 261B corresponds to an example of an "opening portion". The second end portion 261B is connected to the internal flow path 230 located on the third side surface 213 side.

The second reservoir 271 is located on the seventh direction D7 side with respect to the first reservoir 261. The second reservoir 271 can store liquid in at least a part thereof.

The second reservoir 271 has a cylindrical shape. The second reservoir 271 has a first end portion 271A and a second end portion 271B.

The first end portion 271A is an end portion on the seventh direction D7 side. The first end portion 271A corresponds to an example of a "bottom portion". The first end portion 271A has a through hole 270H. The through hole 270H allows the outside and the inside of the second reservoir 271 to communicate with each other. Therefore, the air in the second reservoir 271 passes through the through hole 270H and is released to the atmosphere.

That is, when the changing assembly 253 changes the volume of the first reservoir 261 and the volume of the second reservoir 271, the air in the first reservoir 261 and the air in the second reservoir 271 are released to the atmosphere. Therefore, when the volume of the first reservoir 261 and the volume of the second reservoir 271 are changed, it is possible to suppress the air in the first reservoir 261 and the air in the second reservoir 271 from hindering the operation of the changing assembly 253. As a result, the volume of the first reservoir 261 and the volume of the second reservoir 271 can be smoothly changed.

The second end portion 271B is an end portion on the eighth direction D8 side. The second end portion 271B opens in the eighth direction D8. The second end portion 271B corresponds to an example of an "opening portion". The second end portion 271B is connected to the internal flow path 230 located on the third side surface 213 side. Therefore, the second reservoir 271 can be attached to a surface different from the surface on which the inflow portion 221 into which the liquid flows and the outflow portion 222 out of which the liquid flows are disposed. As a result, it is possible to reduce hindrance of the flow of the liquid flowing into the main body 203 and to reduce hindrance of the flow of the liquid flowing out of the main body 203.

The first reservoir 261 and the second reservoir 271 face each other in the longitudinal direction of the first side surface 211. Even when the change in liquid is large, the liquid can be distributively contained in the first reservoir 261 and the second reservoir 271. In addition, when liquid cannot be contained in one reservoir, liquid can be contained in the other reservoir. As a result, the driving period of the liquid feeder 200 can be lengthened.

In addition, the first reservoir 261 and the second reservoir 271 can be arranged side by side in the longitudinal direction of the first side surface 211. Therefore, the degree of freedom of arrangement of other components of the liquid feeder 200 is improved.

The first attachment portion 215*a*, the second attachment portion 215*b*, the first reservoir 261, and the second reservoir 271 of the present example embodiment are formed of a single member. Therefore, it is possible to reduce the number of steps for assembling the liquid feeder 200. As a result, the assembly efficiency of the liquid feeder 200 is improved. In addition, since the first attachment portion 215*a*, the second attachment portion 215*b*, the first reservoir 261, and the second reservoir 271 are formed of a single member, it is possible to suppress liquid leakage.

The changing assembly 253 includes a first changing assembly 263 and a second changing assembly 273. The first changing assembly 263 and the second changing assembly 273 have the same configuration. Therefore, the first changing assembly 263 will be described, and the description of the second changing assembly 273 will be omitted.

The first changing assembly 263 changes the volume of the reservoir portion 262 that can reserve liquid of the first reservoir 261. The first changing assembly 263 includes a sealing portion 266 and a moving portion 264. The sealing portion 266 is disposed inside the first reservoir 261. The sealing portion 266 seals the liquid in the first reservoir 261. The sealing portion 266 prevents the liquid flowing into the first reservoir 261 from moving to the through hole 260H side beyond the sealing portion 266.

In the present example embodiment, the sealing portion 266 is disposed on the second end portion 261B side of the first reservoir 261. As illustrated in FIG. 12, the liquid can be contained in the reservoir portion 262 of the first reservoir 261 by the sealing portion 266. As a result, in the first reservoir 261, the liquid is contained on the side opposite to the moving portion 264 with the sealing portion 266 as a boundary.

The sealing portion 266 includes a first sealing portion 266*a*, a second sealing portion 266*b*, and a main body 266*c*. The first sealing portion 266*a*, the second sealing portion 266*b*, and the main body 266*c* are similar to the first sealing portion 156*a*, the second sealing portion 156*b*, and the main body portion 156*c* described with reference to FIGS. 6 and 7, and the description thereof is omitted for the purpose of avoiding redundancy.

The moving portion 264 moves the sealing portion 266 along the direction in which the first reservoir 261 extends. The moving portion 264 moves the sealing portion 266 close to or away from the second end portion 261B according to the change in the volume of the liquid. For example, when the volume of the liquid decreases, the moving portion 264 brings the sealing portion 266 close to the second end portion 261B. Therefore, the volume of the reservoir portion 262 of the first reservoir 261 is reduced. Meanwhile, for example, when the volume of the liquid increases, the sealing portion 266 is separated from the second end portion 261B. Therefore, the volume of the reservoir portion 262 of the first reservoir 261 increases. As a result, the volume of the reservoir portion 262 of the first reservoir 261 can be changed with a simple configuration.

For example, as illustrated in FIG. 11, the moving portion 264 moves the sealing portion 266 toward the seventh direction D7. Specifically, the moving portion 264 moves the sealing portion 266 toward the seventh direction D7 until the sealing portion 266 reaches the second end portion 261B. Therefore, the sealing portion 266 approaches the second end portion 261B, and the volume of the reservoir portion 262 decreases. That is, the amount of liquid that can be contained is reduced.

For example, as illustrated in FIG. 12, when the liquid is contained in the reservoir portion 262, the liquid moves the sealing portion 266 in the eighth direction D8. At this time, the moving portion 264 is pressed toward the eighth direction D8 side by the sealing portion 266 according to the amount of liquid contained in the reservoir portion 262. Therefore, the sealing portion 266 is separated from the second end portion 261B, and the volume of the reservoir portion 262 increases. That is, the amount of liquid that can be contained is increased.

The moving portion 264 includes a spring. Specifically, the moving portion 264 is a compression coil spring. In addition, a lubricant is applied to the inner surface of the first reservoir 261 of the present example embodiment. Therefore, it is possible to easily move the sealing portion 266 by the change in the volume of the liquid.

Further, the spring constant of the spring of the moving portion 264 may be different from the spring constant of the spring of the moving portion 274 of the second changing assembly 273. When there is a difference in liquid feeding capability between the first pump 240 and the second pump 220, the difference in liquid feeding capability can be reduced by making the spring constant different.

The sixth liquid container portion 205 further includes a first connecting portion 265 and a second connecting portion 275. The first connecting portion 265 connects the first reservoir 261 and the internal flow path 230. The second connecting portion 275 connects the second reservoir 271 and the internal flow path 230.

Hereinafter, modifications of the example embodiment of the present disclosure will be described. In the following description, members having substantially the same functions as the members described in the present example embodiment are referred to by the same reference numerals, and the description in the present example embodiment is incorporated. In the modification, only portions different from the present example embodiment will be described, and the description of the present example embodiment will be applied to other portions.

Figure 13:
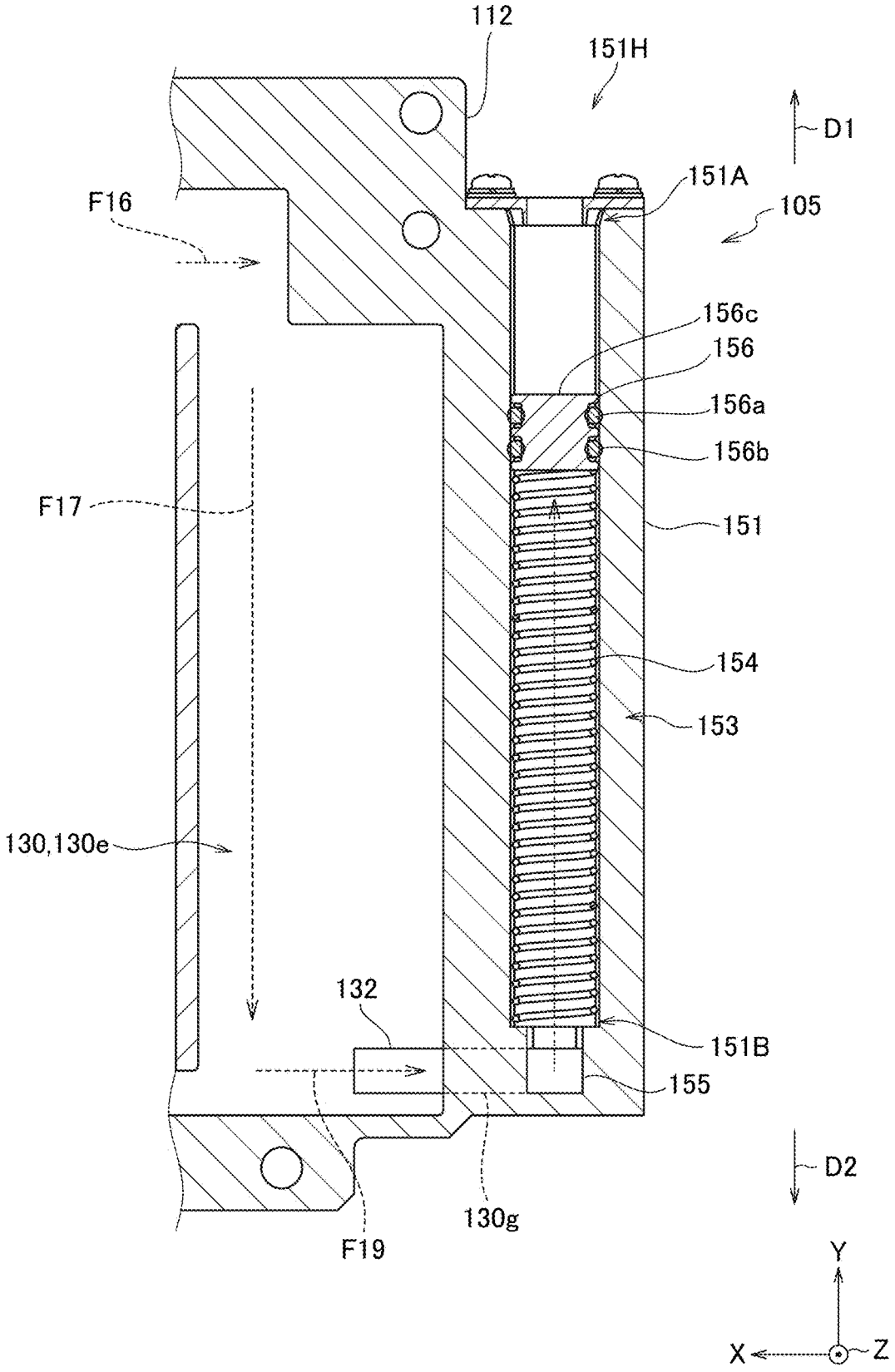
FIG. 13 is a diagram illustrating a second liquid container portion according to Modification 1 of an example embodiment of the present disclosure.
Figure 14:
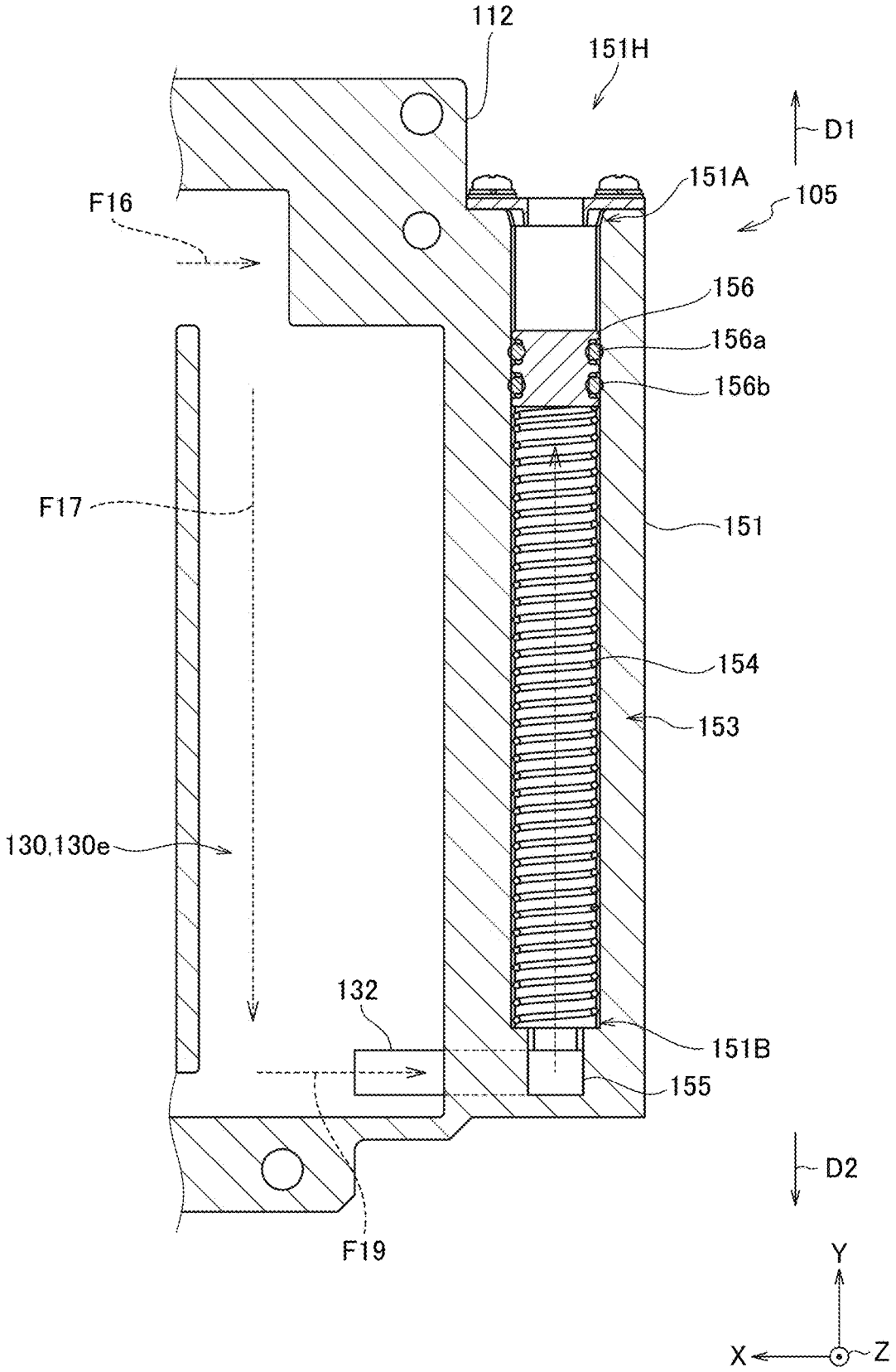
FIG. 14 is another diagram illustrating the second liquid container portion according to Modification 1 of an example embodiment of the present disclosure.

FIG. 13 is a diagram illustrating a second liquid container portion 105 according to Modification 1 of the example embodiment of the present disclosure. FIG. 14 is another diagram illustrating the second liquid container portion 105 according to Modification 1 of the example embodiment of the present disclosure.

As shown in FIG. 13, a sealing portion 156 of Modification 1 is different from that of the second liquid container portion 105 of the present example embodiment in that it is disposed on the first end portion 151A side. In Modification 1, the sealing portion 156 is separated from each of the first end portion 151A and the second end portion 151B. As illustrated in FIG. 13, the spring of a moving portion 154 of Modification 1 is disposed between the second end portion 151B and the sealing portion 156. An end of the spring in the first direction D1 is fixed to the sealing portion 156. Further, an end of the spring in the second direction D2 is fixed to the second end portion 151B of the reservoir 151.

In Modification 1, as illustrated in FIG. 14, the sealing portion 156 moves toward the first end portion 151A side as the liquid is contained in the reservoir portion 152. As illustrated in FIG. 13, as the liquid in the reservoir portion 152 decreases, the sealing portion 156 moves toward the second end portion 151B.

In Modification 1, the spring is a coil spring. For example, as illustrated in FIG. 14, the spring extends as the liquid is contained in the reservoir portion 152. As illustrated in FIG. 13, the spring contracts as the liquid in the reservoir portion 152 decreases. Therefore, according to Modification 1, the changing assembly 153 can increase or decrease the volume of the reservoir 151 according to the change in the liquid. As a result, it is possible to suppress the gas from entering the inside of the cooling mechanism 10 and to suppress the liquid from leaking from the cooling mechanism 10 due to the change in the liquid.

In the present example embodiment, the first main surface 115 faces the heat generating component, but the present disclosure is not limited thereto. For example, the second main surface 116 may face the heat generating component. For example, a heat generating component may be placed on the second main surface 116. When the second main surface 116 faces the heat generating component, the second main surface 116 corresponds to an example of an "opposing surface". That is, the heat of the heat generating member is conducted to the liquid from the second main surface 116. Thus, the liquid increases in volume.

Therefore, according to Modification 2 of the present example embodiment, the changing assembly 153 changes the volume of the reservoir 151 according to the change in the volume of the liquid. Therefore, even if the volume of the liquid increases by the thermal expansion of the liquid due to the heat of the heat generating component mounted on the second main surface 116, the changing assembly 153 increases the volume of the reservoir 151. As a result, even if the volume of the liquid increases and the internal pressure in the first liquid container portion 101 increases, it is possible to suppress the liquid from leaking from the cooling mechanism 10.

The present example embodiment and the modifications have been described above with reference to the drawings. However, the present disclosure is not limited to the above example embodiment and modifications, and can be implemented in various modes without departing from the gist of the present disclosure. The plurality of constituent elements disclosed in the above example embodiment and modifications can be appropriately modified.

The drawings schematically illustrate each constituent element mainly in order to facilitate understanding of the disclosure, and the thickness, length, number, interval, and the like of the illustrated constituent elements may be different from the actual ones for convenience of creation of the drawings. The configuration of each constituent element illustrated in the above example embodiment is an example and is not particularly limited, and it goes without saying that various modifications can be made without substantially departing from the effects of the present disclosure.

Note that the present technique can have the following configurations.

(1) A container including: a first container portion including a flow path through which liquid passes, the flow path being provided inside the first container portion; and a second container portion connected to the flow path and capable of containing the liquid; wherein the second container portion includes: a reservoir capable of storing the liquid in at least a portion of the reservoir; and a changing assembly to change volume of the reservoir according to a change in the liquid.

(2) The container according to (1), in which the first container portion includes a facing surface that opposes a heat generating component; the change in the liquid includes a volume of the liquid that is changed as heat of the heat generating component is conducted; and the changing assembly changes the volume of the reservoir according to a change in the volume of the liquid.

(3) The container according to (1) or (2), in which the second container portion is a bottomed cylindrical structure in which the flow path side includes an opening, and a bottom portion of the second container portion includes a hole.

(4) The container according to any of (1) to (3), in which the first container portion further includes: a first surface on which an inflow portion into which the liquid flows and an outflow portion from which the liquid flows out are located; and a second surface different from the first surface; and the opening of the second container portion is connected to the flow path located on the second surface side.

(5) The container according to (4), in which a length of the second surface in the longitudinal direction is longer than a length of the first surface in the longitudinal direction; and a length of the second container portion is shorter than a length of the second surface in the longitudinal direction.

(6) The container according to any of (1) to (5), in which the changing assembly includes: a sealing portion that is located inside the reservoir and seals the liquid in the reservoir; and a moving portion that moves the sealing portion along a direction in which the reservoir extends; and the moving portion causes the sealing portion to approach or separate from the opening according to the change in the volume of the liquid.

(7) The container according to (6), in which the second surface extends in a direction intersecting a direction in which gravity acts; and the reservoir extends along the second surface.

(8) The container according to any of (1) to (7), in which the second container portion further includes a connecting portion that connects the reservoir and the flow path; and an inner diameter of the connecting portion is smaller than an inner diameter of the reservoir.

(9) The container according to (8), in which the moving portion includes a spring; and a length of the spring when the spring does not contract is longer than a length from the opening of the reservoir to the bottom portion, and the spring is located between the bottom portion and the sealing portion.

(10) The container according to any of (1) to (9), in which the flow path includes: a first flow path that conducts heat to liquid passing through the first flow path; a second flow path on an upstream side of the first flow path; and a third flow path on a downstream side of the first flow path; and the connecting portion is connected to the third flow path.

(11) The container according to any of (1) to (10), in which a lubricant is applied to an inner surface of the reservoir.

(12) A cold plate including the container according to any of (1) to (11).

(13) A liquid feeder including: the container according to claim 1; a first pump to deliver the liquid to an outflow portion; and a second pump to deliver the liquid flowing in from an inflow portion to the first pump; wherein the first container portion includes a first surface on which the inflow portion and the outflow portion are located; and the first pump and the second pump are located between the first surface and the second container portion, and are adjacent to each other in a longitudinal direction of the first surface.

(14) The liquid feeder according to (13), in which the flow path includes a connection flow path that connects the first pump and the second pump; and the second container portion is connected to the connection flow path.

(15) The liquid feeder according to (13) or (14), in which the reservoir includes: a first reservoir capable of storing the liquid in at least a portion of the first reservoir; and a second reservoir capable of storing the liquid in at least a portion of the second reservoir; and the first reservoir and the second reservoir oppose each other in the longitudinal direction of the first surface.

(16) The liquid feeder according to (15), in which each of the first reservoir and the second reservoir includes a bottomed cylindrical structure in which the flow path side is opened, and each of a bottom portion of the first reservoir and a bottom portion of the second reservoir includes a hole.

(17) The liquid feeder according to any of (13) to (16), in which the first container portion further includes: a first attachment portion to which the first pump is attached; and a second attachment portion to which the second pump is attached; and the first attachment portion, the second attachment portion, the first reservoir, and the second reservoir are portions of a single monolithic structure.

The present disclosure is applicable to, for example, a container, a cold plate, and a liquid feeder.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A container comprising:

a first container portion including a flow path through which liquid passes, the flow path being provided inside the first container portion; and a second container portion connected to the flow path and capable of containing the liquid; wherein the second container portion includes:

a reservoir capable of storing the liquid in at least a portion of the reservoir; and a volume changer to change volume of the reservoir according to a change in the liquid;

the first container portion further includes:

a first surface on which an inflow portion into which the liquid flows and an outflow portion from which the liquid flows out are located; and a second surface different from the first surface; and an opening of the second container portion is connected to the flow path located on a second surface side.

2. The container according to claim 1, wherein the first container portion includes a facing surface that opposes a heat generator;

the change in the liquid includes a volume of the liquid that is changed as heat of the heat generator is conducted; and the volume changer changes the volume of the reservoir according to a change in the volume of the liquid.

3. The container according to claim 2, wherein the second container portion is a bottomed cylindrical structure in which the flow path side includes an opening, and a bottom portion of the second container portion includes a hole.

4. The container according to claim 1, wherein a length of the second surface in the longitudinal direction is longer than a length of the first surface in the longitudinal direction; and a length of the second container portion is shorter than a length of the second surface in the longitudinal direction.

5. The container according to claim 1, wherein the changing assembly volume changer includes:

a sealing portion that is located inside the reservoir and seals the liquid in the reservoir; and a moving portion that moves the sealing portion along a direction in which the reservoir extends; and the moving portion causes the sealing portion to approach or separate from the opening according to the change in the volume of the liquid.

6. The container according to claim 5, wherein
the second surface extends in a direction intersecting a direction in which gravity acts; and
the reservoir extends along the second surface.

7. The container according to claim 6, wherein
the second container portion further includes a connecting portion that connects the reservoir and the flow path; and
an inner diameter of the connecting portion is smaller than an inner diameter of the reservoir.

8. The container according to claim 7, wherein
the moving portion includes a spring; and
a length of the spring when the spring does not contract is longer than a length from the opening of the reservoir to the bottom portion, and the spring is located between the bottom portion and the sealing portion.

9. The container according to claim 7, wherein
the flow path includes:
a first flow path that conducts heat to liquid passing through the first flow path;
a second flow path on an upstream side of the first flow path; and
a third flow path on a downstream side of the first flow path; and
the connecting portion is connected to the third flow path.

10. The container according to claim 9, wherein a lubricant is applied to an inner surface of the reservoir.

11. A cold plate comprising the container according to claim 1.

12. A liquid feeder comprising:
the container according to claim 1;
a first pump to deliver the liquid to an outflow portion; and
a second pump to deliver the liquid flowing in from an inflow portion to the first pump; wherein
the first container portion includes a first surface on which the inflow portion and the outflow portion are located; and
the first pump and the second pump are located between the first surface and the second container portion, and are adjacent to each other in a longitudinal direction of the first surface.

13. The liquid feeder according to claim 12, wherein
the flow path includes a connection flow path that connects the first pump and the second pump; and
the second container portion is connected to the connection flow path.

14. The liquid feeder according to claim 13, wherein
the reservoir includes:
a first reservoir capable of storing the liquid in at least a portion of the first reservoir; and
a second reservoir capable of storing the liquid in at least a portion of the second reservoir; and
the first reservoir and the second reservoir oppose each other in the longitudinal direction of the first surface.

15. The liquid feeder according to claim 14, wherein each of the first reservoir and the second reservoir includes a bottomed cylindrical structure in which the flow path side is opened, and each of a bottom portion of the first reservoir and a bottom portion of the second reservoir includes a hole.

16. The liquid feeder according to claim 15, wherein
the first container portion further includes:
a first attachment portion to which the first pump is attached; and
a second attachment portion to which the second pump is attached; and
the first attachment portion, the second attachment portion, the first reservoir, and the second reservoir are portions of a single monolithic structure.

* * * * *